US005339384A

United States Patent [19]

Chen

[11] Patent Number: 5,339,384

[45] Date of Patent: Aug. 16, 1994

[54] CODE-EXCITED LINEAR PREDICTIVE CODING WITH LOW DELAY FOR SPEECH OR AUDIO SIGNALS

[75] Inventor: Juin-Hwey Chen, Neshanic Station, N.J.

[73] Assignee: AT&T Bell Laboratories, Murray Hill, N.J.

[21] Appl. No.: 200,805

[22] Filed: Feb. 22, 1994

Related U.S. Application Data

[63] Continuation of Ser. No. 837,522, Feb. 18, 1992.

[51] Int. Cl.[5] ..... G10L 3/00; G10L 9/14; G10L 9/18

[52] U.S. Cl. ..... 395/2.2; 395/2.32; 395/2.29

[58] Field of Search ..... 395/2, 2.24, 2.3–2.32, 395/2.2; 381/29–51

[56] References Cited

U.S. PATENT DOCUMENTS

| | | | |
|---|---|---|---|
| 4,899,385 | 2/1990 | Ketchum et al. | 395/2.32 |
| 4,963,034 | 10/1990 | Cuperman et al. | 395/2.31 |
| 4,969,192 | 11/1990 | Chen et al. | 395/2.31 |
| 5,142,583 | 8/1992 | Galand et al. | 395/2.29 |

OTHER PUBLICATIONS

Study Group XV–Question:21/XV (16 kbit/s speech coding), "Detailed Description of AT&T's LD–CELP Algorithm," Nov. 1989.

Committee: T1Y1.15 16 Kbit/s Voice Encoding and Line Format, "Preliminary Description of the Fixed–Point Version of the 16 Kbit/s LD–CELP Algorithm," Jul. 3, 1990.

Dimolitsas, "Draft Recommendation on 16 Kbit/s Voice Coding", Geneva, Nov. 11–22, 1991, CCITT, Study Group XV, pp. 1–23.

"A Fixed–point Architecture for the 16 Kb/s LD–CELP Algorithm", CCITT, Study Group XV, Feb. 1991.

J–H. Chen, "A robust low–delay CELP speech coder at 16 kbit/s," Proc. Globecom, pp. 1237–1241 (Nov. 1989).

J–H. Chen, "High–quality 16 kb/s speech coding with a one–way delay less than 2 ms," Proc. ICASSP, pp. 453–456 (Apr. 1990).

J–H. Chen, M. J. Melchner, R. V. Cox and D. O. Bowker, "Real–time implementation of a 16 kb/s low–delay CELP speech coder," Proc. ICASSP, pp. 181–184 (Apr. 1990).

R. B. Blackman and J. W. Tukey, The Measurement of Power Spectra, Dover, New York, 1958.

N. C. Geckinli and D. Yavuz, "Some Novel Windows and a Concise Tutorial Comparison of Window Families," IEEE Trans. Acoustics, Speech and Signal Processing, vol. ASSP–26, No. 6, Dec. 1978, pp. 501–507.

Y. Tohkura and F. Itakura, "Spectral Smoothing Techniques in PARCOR Speech Analysis–Synthesis," IEEE Trans. on Acoustics, Speech, and Signal Processing, vol. ASSP–26, No. 6, Dec. 1978.

T. P. Barnwell, III, "Recursive windowing for generating autocorrelation coefficients for LPC analysis," IEEE Trans. Acoust., Speech, Signal Processing, vol. ASSP–29(5), pp. 1062–1066, Oct. 1981.

M. R. Schroeder and B. S. Atal, "Code Excited Linear Prediction (CELP); high quality speech at very low bit rates," *Proc. ICASSP*, pp. 937–940 (1985).

L. R. Rabiner and R. W. Schafer, Digital Processing of Speech Signals, Prentice–Hall, Inc., Englewood Cliffs, N.J. (1978).

T. Moriya, "Medium–delay 8 kbit/s speech coder based on conditional pitch prediction," Proc. Int. Conf. Spoken Language Processing (Nov. 1990).

*Primary Examiner*—David D. Knepper

*Attorney, Agent, or Firm*—William Ryan; David M. Rosenblatt

[57] ABSTRACT

A code-excited linear-predictive (CELP) coder for speech or audio transmission at compressed (e.g., 16 kb/s) data rates is adapted for low-delay (e.g., less than five ms. per vector) coding by performing spectral analysis of at least a portion of a previous frame of simulated decoded speech to determine a synthesis filter of a much higher order than conventionally used for decoding synthesis and then transmitting only the index for the vector which produces the lowest internal error signal. Modified perceptual weighting parameters and a novel use of postfiltering greatly improve tandeming of a number of encodings and decodings while retaining high quality reproduction.

8 Claims, 6 Drawing Sheets

CODE-EXCITED LINEAR PREDICTIVE CODING WITH LOW DELAY FOR SPEECH OR AUDIO SIGNALS

This application is a continuation of application Ser. No. 07/837,522, filed on Feb. 18, 1992 and claims priority thereto.

FIELD OF THE INVENTION

This invention relates to digital communications, and more particularly to digital coding of speech or audio signals with low coding delay and high-fidelity at reduced bit-rates.

RELATED APPLICATIONS

This application is related to subject matter disclosed in U.S. patent application Ser. No. 07/298451, by J-H Chen, filed Jan. 17, 1989, now abandoned, and copending U.S. patent application Ser. No. 07/757,168 by J-H Chen, filed Sep. 10, 1991, assigned to the assignee of the present application. Also related to the subject matter of this application is a copending application Ser. No., filed Feb. 18, 1992 by J-H Chen, R. Cox and N. Jayant entitled "Low Delay Code-Excited Linear Predictive Coder For Speech Or Audio Signals," which application is assigned to the assignee of the present application. Each of these patent applications is incorporated by reference in the present application as if set forth in its entirety herein.

BACKGROUND OF THE INVENTION

Introduction

The International Telegraph and Telephone Consultative Committee (CCITT), an international communications standards organization, has been developing a standard for 16 kb/s speech coding and decoding for universal applications. The standardization process included the issuance by the CCITT of a document entitled "Terms of Reference" prepared by the ad hoc group on 16 kbit/s speech coding (Annex 1 to question 21/XV), June 1988.

Presently, the candidate being considered for the standard is Low-Delay Code Excited Linear Predictive Coding (hereinafter, LD-CELP) described in substantial part in the incorporated application Ser. No. 07/298451. Aspects of this coder are also described in J-H Chen, "A robust low-delay CELP speech coder at 16 kbit/s, "Proc. GLOBECOM, pp. 1237–1241 (Nov. 1989); J-H Chen, "High-quality 16 kb/s speech coding with a one-way delay less than 2 ms, "Proc. ICASSP, pp. 453–456 (April 1990); J-H Chen, M. J. Melchner, R. V. Cox and D. O. Bowker, "Realtime implementation of a 16 kb/s low-delay CELP speech coder, "Proc. ICASSP, pp. 181–184 (April 1990); all of which papers are hereby incorporated herein by reference as if set forth in their entirety. The patent application Ser. No. 07/298,451 and the cited papers incorporated by reference describe aspects of the LD-CELP system as evaluated in Phase 1. Accordingly, the system described in these papers and the application Ser. No. 07/298,451 will be referred to generally as the Phase 1 System.

A document further describing the LD-CELP candidate standard system was presented in a document entitled "Draft Recommendation on 16 kbit/s Voice Coding," submitted to the CCITT Study Group XV in its meeting in Geneva, Switzerland during Nov. 11–22, 1991 (hereinafter, "Draft Recommendation"), which document is incorporated herein by reference in its entirety. For convenience, and subject to deletion as may appear desirable, part or all of the Draft Recommendation is also attached to this application as Appendix 1. The system described in the Draft Recommendation has been evaluated during Phase 2 of the CCITT standardization process, and will accordingly be referred to as the Phase 2 System. Other aspects of the Phase 2 System are also described in a document entitled "A fixed-point Architecture for the 16 kb/s LD-CELP Algorithm" (hereinafter, "Architecture Document") submitted by the assignee of the present application to a meeting of Study Group XV of the CCITT held in Geneva, Switzerland on Feb. 18 through Mar. 1, 1991. The Architecture Document is hereby incorporated by reference as if set forth in its entirety herein and a copy of that document is attached to this application for convenience as Appendix 2. Also incorporated by reference as descriptive of the Phase 2 System and J. H. Chen, Y. C. Lin, and R. V. Cox, "A fixed point 16 kb/s LD-CELP Algorithm," Proc. ICASSP, pp. 21–24, (May 1991).

WINDOWING

In many signal processing applications, including speech and audio signal coding, it proves convenient to use part of a sequence of signals for selective processing. For example, a sequence of time signals, such as samples of a speech signal, will be processed in groups or subsequences. For this purpose, the notion of a "window" is typically used to define a current (or past) subsequence, with the particular values changing as the window is allowed to shift with evolving time. In a similar way, the notion of a spectral window is conveniently used for processing in the frequency domain. Other kinds of windows are used in different domains and for particular kinds of signal processing. Some of the commonly used windows are described in R. B. Blackman and J. W. Tukey, The Measurement of Power Spectra, Dover: New York, 1958; and N. C. Geckinli and D. Yavuz, "Some Novel Windows and a Concise Tutorial Comparison of Window Families," IEEE Trans. Acoustics, Speech and Signal Processing, Vol. ASSP-26, No. 6, December 1978, pp. 501–507. The application of spectral windows in the context of a speech synthesis system is described in Y. Tohkura and F. Itakura, "Spectral Smoothing Techniques in PARCOR Speech Analysis-Synthesis," IEEE Trans. on Acoustics, Speech, and Signal Processing, Vol. ASSP-26, No. 6, December 1978. Also attached as Appendix 3 is a descriptive of the Phase 2 system as updated in accordance with the present invention.

In the past, the CCITT has only standardized fixed-point speech encodings. One principle reason for this was that floating-point processors were either unnecessary or unavailable at the time the standards were proposed. Another reason is that it is relatively easy to fully specify an algorithm with fixed-point arithmetic, a so-called bit-exact specification. By contrast, a floating-point specification may have difficulty with specific arithmetic precision, especially as implemented on a variety of hardware platforms. Therefore, with a fixed-point specification, test vectors can be used to verify conformance of a particular codec with the standard, while this would be much more difficult for floating-point specifications. A third reason is that fixed-point implementations usually result in lower cost and lower power consumption than floating-point implementations. In addition, a fixed-point specification facilitates VLSI implementations.

The LD-CELP system, in common with many linear predictive coding (LPC) arrangements, uses sets of autocorrelation coefficients to derive the LPC predictor coefficients used in updating the various adaptive elements of the system (i.e., gain predictor and LPC synthesis filter). See the documents describing the Phase 1 System cited above. The autocorrelation coefficients, in turn, are formed using windowed values of respective Phase 1 System signal sequences. In particular, the recursive windowing method described in T. P. Barnwell, III, "Recursive windowing for generating autocorrelation coefficients for LPC analysis," IEEE Trans. Acoust., Speech, Signal Processing, Vol. ASSP-29(5), pp. 1062–1066, October 1981, is advantageously employed in forming the autocorrelation coefficients of the Phase 1 System.

For the reasons given above, it proves advantageous to implement a 16-bit fixed-point version of the LD-CELP algorithm. However, implementation of Barnwell's recursive windowing techniques proves difficult when using fixed-point processing. In part, this is because 16-bit fixed-point arithmetic generally does not provide enough precision for the 50-th order Durbin's recursion used in the Phase 1 System, nor does it have a sufficient dynamic range to handle the recursive windowing method used in the Phase 1 System in performing the autocorrelation functionality.

Another problem arising in the context of the Phase 1 System (and the Phase 2 System described in Appendices 1 and 2) is one related to decoding certain sustained speech patterns, such as sustained vowel sounds. While such troublesome speech patterns are rare, they can occur with some regularity when coding and decoding certain machine-generated speech having little of the natural variation with time that human speech typically possesses. In particular, it has been found that such sustained sounds can cause the adaptive LPC synthesis filter at a decoder to fail to accurately track the LPC synthesis filter at the encoder. This can cause temporary unsatisfactory reception of the decoded speech.

SUMMARY OF THE INVENTION

In accordance with aspects of illustrative embodiments of the present invention, a method and corresponding system are provided which effectively avoid impairments or limitations of prior coders and decoders and produces improved performance. These improvements and distinctions are all achieved in an illustrative embodiment featuring fixed-point processing within the low delay constraints sought in the CCITT standardization process.

Briefly, it has proven advantageous to replace the Barnwell recursive windowing method by a new hybrid windowing method which is partially recursive and partially non-recursive. This new method avoids the dynamic range problem and the more complex double-precision arithmetic that would otherwise have been required. In particular, the recursive window of the Phase 1 System is advantageously replaced by a novel hybrid window comprising a recursively decaying tail and a section of non-recursive samples at the beginning.

In accordance with another aspect of the present invention, the above-noted problem arising from some sustained vowel sounds has been avoided in an improved Phase 2 System by introducing a simple additional processing step before the 50th order Durbin's recursion employed in both the Phase 1 and Phase 2 Systems. Thus by modifying the magnitude of the autocorrelation coefficients developed from the modified windowed signals, the LPC coefficients developed by the Durbin recursion are found to avoid the narrow spectral peaks that contribute to the occasional anomalous behavior of the Phase 2 System when presented with the sometimes troublesome sustained vowel signals. The modifying of the autocorrelation coefficients conveniently forms a simple postprocessing step to the normal window processing. In fact, the modifying of the autocorrelation coefficients can advantageously accompany the prior modification of the power-related autocorrelation coefficient, r(0). That is, previously, the value of f(0) has been modified by a factor slightly greater than 1, e.g., 1.00390625, to, in effect, add white noise at a level well below the speech power to add stability to certain of the LD-CELP processes as described in the Draft Recommendation, for example. This multiplying then is then extended in accordance with the present invention to others of the correlation coefficients prior to deriving the LPC coefficients using Durbin's recursion or other suitable means.

These and other advances provided by the present invention are achieved, in an illustrative embodiment, in a speech coder in a low delay code excited linear predictive coding (LD-CELP) system of the type characterized above as the Phase 2 System.

DETAILED DESCRIPTION

Figure 1A:
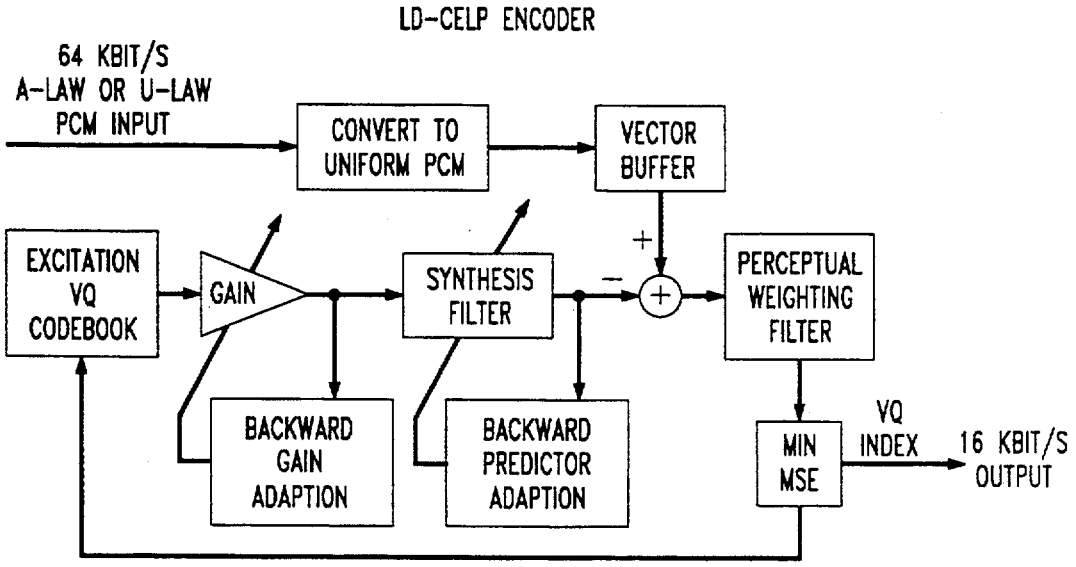
FIG. 1A (PRIOR ART)
FIGS. 1A and 1B are simplified block diagrams of a Phase 2 LD-CELP encoder and decoder, respectively, in accordance with an illustrative embodiment of the present invention.
Figure 1B:
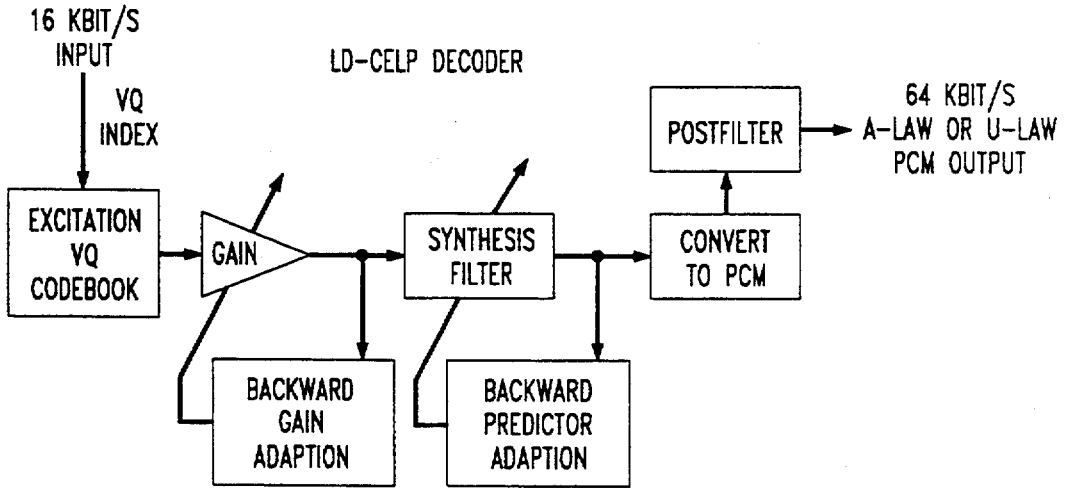
FIG. 1B (PRIOR ART)

1. The above-cited Draft Recommendation describes the Phase 2 system in detail and should be referred to for additional information in making and using the present invention. FIGS. 1A and 1B correspond to FIG. 1 of the Draft Recommendation and FIGS. 2 through 8 correspond to identically numbered figures in the Draft Recommendation.

2. Review of floating-point LD-CELP

The original floating-point LD-CELP coder is shown in FIG. 1A. More details about this coder can be found in the Phase 1 documents identified above, including U.S. patent application Ser. No. 07/298451. Here only its main features are reviewed.

In this coder, both the gain 101 and the 50-th order LPC predictor 102 are backward-adaptive based on previously quantized signals, and only the excitation is coded and transmitted forward to the decoder. The input speech is coded vector-by-vector, where each vector illustratively contains 5 samples. Vector quantization (VQ) is used to encode each 5-dimensional excitation vector into 10 bits, resulting in a total bit-rate of 2 bits/sample, or 16 kb/s with a sampling rate of 8 kHz. The codebook search is done in a closed-loop, or "analysis-by-sythesis" manner typical to all CELP coders. See, e.g., M. R. Schroeder and B. S. Atal, "Code Excited Linear Prediction (CELP); high quality speech at very low bit rates, "*Proc. ICASSP*, pp. 937–940 (1985). The 50-th order LPC predictor is implemented as a direct-form transversal filter. The filter coefficients are backward adapted once every 4 vectors (20 samples) by performing LPC analysis on previously coded speech. The LD-CELP decoder performs the same LPC analysis as the encoder does, so there is no need to transmit LPC parameters. Similarly, the gain is also backward-adaptive. It is updated once every vector by using a 10-th order adaptive linear predictor in the logarithmic gain domain. The coefficients of this log-gain predictor are also updated once every 4 vectors by performing a similar LPC analysis on the logarithmic gains of previously quantized and scaled excitation vectors. The perceptual weighting filter is also of order 10, and its coefficients are also updated once every 4 vectors by LPC analysis, although the analysis is based on the input speech rather than the coded speech. The time period between predictor updates is considered a "frame" of LD-CELP. Thus, the "frame size" of LD-CELP is 20 samples, although the actual speech buffer size is only 5 samples.

In all three LPC analyses mentioned above, a modified version of Barnwell's recursive windowing method is first used to calculate the autocorrelation coefficients. Durbin's recursion (see, L. R. Rabiner and R. W. Shafer, Digital Processing of Speech Signals, Prentice-Hall, Inc., Englewood Cliffs, N.J. (1978)) is then used to convert the autocorrelation coefficients to LPC predictor coefficients.

3. Overview of fixed-point LD-CELP algorithm

Figure 2:
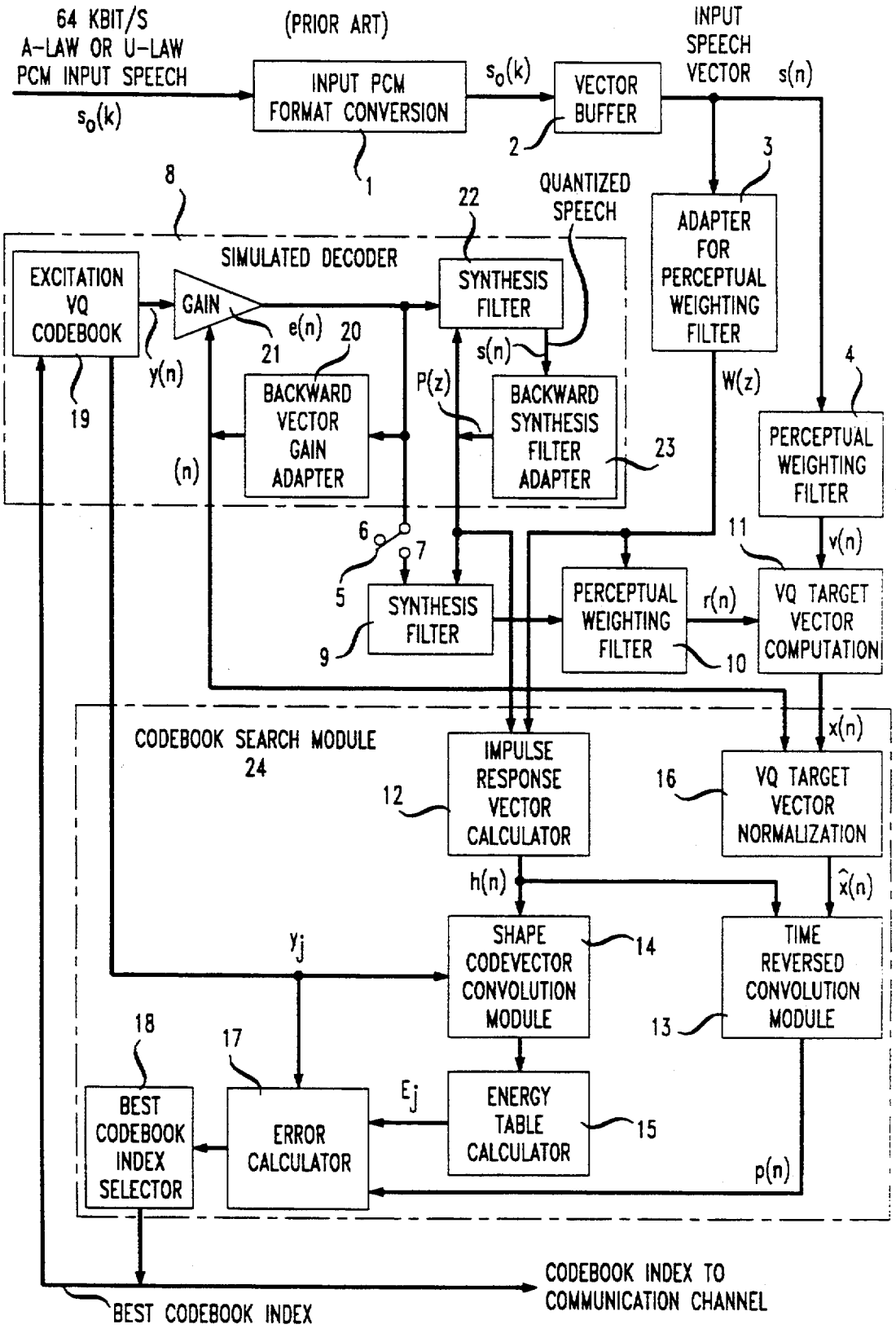
FIG. 2 (PRIOR ART)
FIG. 2 is a schematic block diagram of a Phase 2 LD-CELP encoder in accordance with an illustrative embodiment of the present invention.

The newly created fixed-point LD-CELP coder (the Phase 2 coder) is shown in FIG. 2. This coder is mostly the same as the original LD-CELP coder in FIG. 1 except that the recursive windowing method has been replaced by a hybrid windowing method. The changes will be described in detail in the following two sections.

4. Hybrid windowing method

In the original recursive windowing method, the products of the current speech sample and previous samples are passed through a bank of third-order IIR filters, and the autocorrelation coefficients are obtained at the outputs of these IIR filters. Since each speech sample is represented by 16 bits, the product of two speech samples has a dynamic range of 32 bits. Thus, to filter this product term, 32-bit by 32-bit multiplication and addition is required to fully preserve the precision. Such computation requires double-precision arithmetic in a 16-bit fixed-point DSP device. Since double-precision arithmetic generally takes significantly more DSP instruction cycles than single-precision arithmetic, and since autocorrelation computation is a significant portion of the total complexity of LD-CELP, implementing recursive windowing in double precision results in very high complexity.

To avoid double-precision arithmetic, an alternative is to use a conventional block-by-block, non-recursive windowing method with, for instance, a Hamming window or half Hamming window. See, e.g., T. Moriya, "Medium-delay 8 kbit/s speech coder based on conditional pitch prediction", Proc. Int. Conf. Spoken Language Processing (Nov. 1990). However, since our frame size of 20 samples is much smaller than the typical window size of 160 to 200 samples, this means a very significant window overlap and a very high computational complexity. In addition, it was found that Hamming windowing gave poorer prediction gain and perceptual speech quality than recursive windowing in the context of backward-adaptive LPC analysis. Therefore, it is desirable to at least keep the window shape similar to that of the recursive window.

Figure 4A:
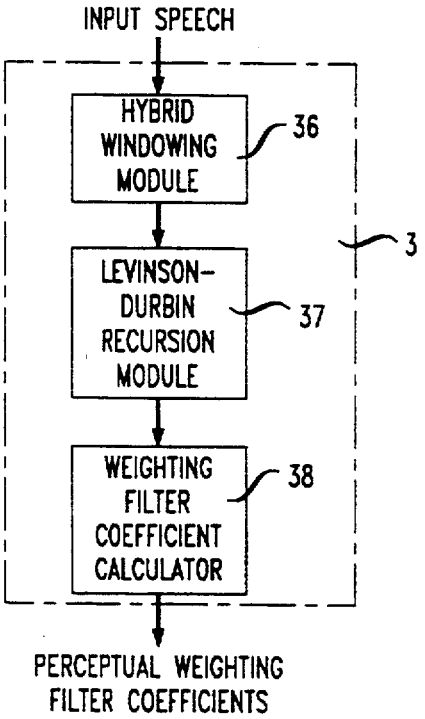
FIG. 4A (PRIOR ART)
FIG. 4A is a schematic block diagram of a perceptual weighting filter adapter for use in a Phase 2 System in accordance with an illustrative embodiment of the present invention.
Figure 4B:
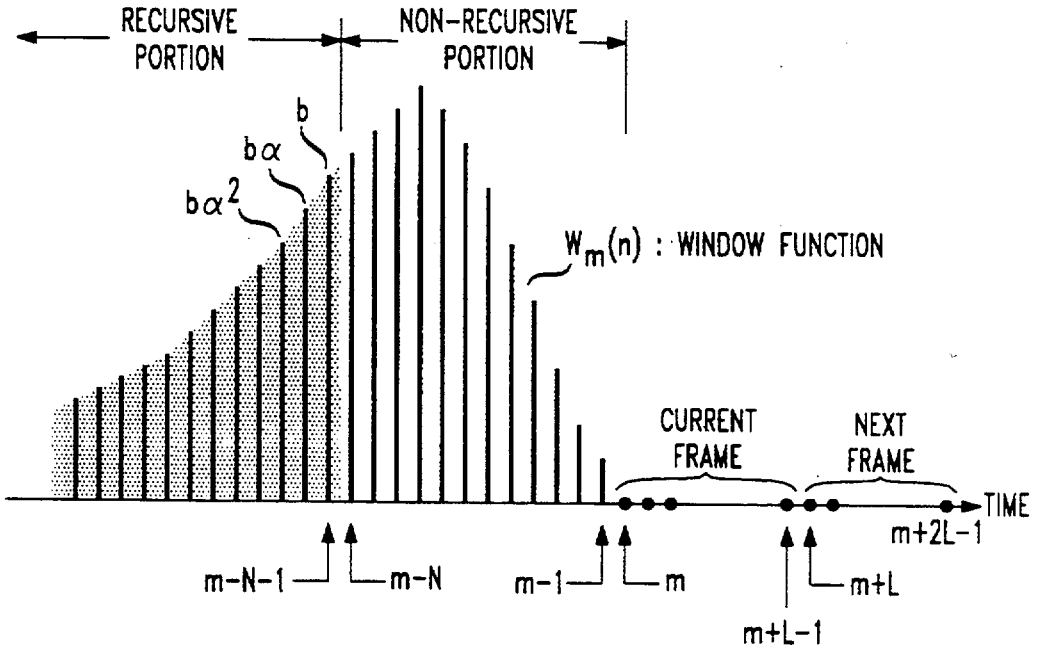
FIG. 4B illustrates a hybrid window used in a Phase 2 System in accordance with an illustrative embodiment of the present invention.

The present invention provides a novel hybrid window which consists of a recursively decaying tail and a section of non-recursive samples at the beginning (see FIG. 4B). The tail of the window is exponentially decaying with a decaying factor $\alpha$ slightly less than unity. The non-recursive part of the window is a section of the sine function and it makes the shape of the entire window similar to that of the original recursive window. An example of such a hybrid window is shown in FIG. 4B. In the following, it will first be shown how to determine the window parameters, and then the procedure to calculate autocorrelation coefficients using this hybrid window will be described.

Figure 3:
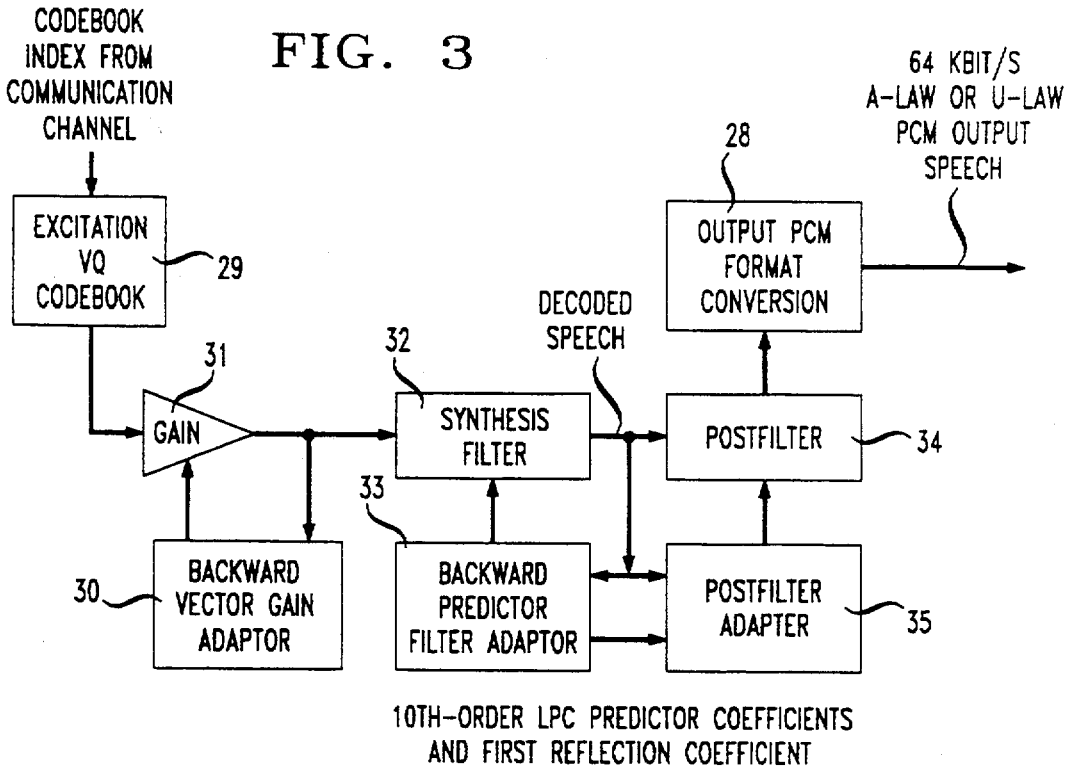
FIG. 3 is a schematic block diagram of a Phase 2 LD-CELP decoder in accordance with an illustrative embodiment of the present invention.

Let s(n) denote the signal for which we want to calculate the autocorrelation coefficients. To be general, let us assume that the signal samples corresponding to the current LD-CELP frame are s(m),s s(m+1), s(m+2), . . . , s(m+L−1). Then, for backward-adaptive LPC analysis, the hybrid window is applied to all signal samples with a time index less than m (as shown in FIG. 3). Let there be N non-recursive samples in the hybrid window function. Then, the signal samples s(m−1), s(m−2), . . . , s(m−N) are all weighted by the non-recursive portion of the window. Starting with s(m−N−1), all signal samples to the left of (and including) this sample are weighted by the recursive portion of the window, which has values b, b$\alpha$, b$\alpha^2$, . . . , where $0<b<1$ and $0<\alpha<1$.

At time m, the hybrid window function $w_m(n)$ is defined as $$w_m(n) = \begin{cases} f_m(n) = b\,\alpha^{-[n-(m-N-1)]}, & \text{if } n \leqq m-N-1 \\ g_m(n) = -\sin[c(n-m)], & \text{if } m-N \leqq n \leqq m-1 \\ 0, & \text{if } n \geqq m. \end{cases} \quad (1)$$

To suppress the sidelobe of the Fourier transform of the window, a smooth junction between the sine function and the exponential function at $n=m-N-1$ is desired. Therefore, the following two continuity conditions are imposed: (1) the functions $f_m(n)$ and $g_m(n)$ have the same value at $n=m-N-1$, and (2) the slopes of these two function curves are also the same at $n=m-N-1$. From the first condition and Eq. (1), we have $$b=-\sin[c(m-N-1-m)]=\sin[c(N+1)]. \quad (2)$$

The second condition yields $$-b\ln\alpha=-c\cos[c(m-N-1-m)]=-c\cos[c(N+1)] \quad (3)$$

Substituting Eq. (2) into Eq. (3) gives $$-\ln\alpha = -c\frac{\cos[c(N+1)]}{\sin[c(N+1)]} = -c\cot[c(N+1)]. \quad (4)$$

In designing the hybrid window, the decaying factor $\alpha$ is first determined, based on how long the effective length of the exponential tail is to be. Then, N, the number of non-recursive samples, is determined based on how the initial part of the window is to be shaped and how much computational complexity can be accommodated by the processing systems. (The larger the number N, the higher the complexity.) Once the parameters $\alpha$ and N are determined, the only unknown in Eq. (4) is the constant c.

Since Eq. (4) is a non-linear equation on c, it is not convenient to directly solve for c. However, a very accurate solution can be obtained by using iterative approximation techniques. From FIG. 4B and Eq. (2), it should be clear that the desired range for $c(N+1)$ is between $\pi/2$ and $\pi$. Note that $-c\cot[c(N+1)]$ is zero at $c(N+1)=\pi/2$, and its value monotonically increases and finally approaches infinity as $c(N+1)$ increases and approach $\pi$. Also note that $-\ln\alpha$ is a small positive constant. Therefore, the two curves $y(c)=-c\cot[c(N+1)]$ and $y(c)=-\ln\alpha$ always have a unique intersection in the range of $\pi/2<c(N+1)<\pi$. It was found that for an initial step size of $\pi/8$ and an initial guess of $3\pi/4$ for $c(N+1)$, and if the step size is reduced by half every time the intersection point is "crossed over" while searching for it, then usually within 20 iterations the two sides of Eq. (4) to agree for at least 5 decimal digits. Once the value of c is found, the value of b is easily obtained by using Eq. (2). Note that this iterative method to find c and b is done only once during the coder design stage.

To describe the way to calculate autocorrelation coefficients using the hybrid window, let us define the window-weighted signal for the current frame (starting at time m) to be $$s_m(n) = s(n)w_m(n) = \begin{cases} s(n)f_m(n) = s(n)b\alpha^{-[n-(m-N-1)]}, & \text{if } n \leqq m-N-1 \\ s(n)g_m(n) = -s(n)\sin[c(n-m)], & \text{if } m-N \leqq n \leqq m-1 \\ 0, & \text{if } n \geqq m. \end{cases} \quad (5)$$

For an M-th order LPC analysis, we need to calculate the autocorrelation coefficients $R_m(i)$ for $i=0, 1, 2, \ldots, M$. The i-th autocorrelation coefficient for the current frame can be expressed as $$R_m(i) = \sum_{n=-\infty}^{m=1} s_m(n)s_m(n-i) = r_m(i) + \sum_{n=m-N}^{m-1} s_m(n)s_m(n-i), \quad (6)$$

where $$r_m(i) = \sum_{n=-\infty}^{m-N-1} s_m(n)s_m(n-i) = \sum_{n=-\infty}^{m-N-1} s(n)s(n-i)f_m(n)f_m(n-i). \quad (7)$$

On the right-hand side of Eq. (6), the first term $r_m(i)$ is the "recursive component" of $R_m(i)$, while the second term is the "non-recursive component". The finite summation of the non-recursive component is calculated for each frame. On the other hand, we obviously cannot directly calculate the infinite summation of the recursive component; instead, we have to calculate it recursively. The following paragraphs explain how.

Suppose we have calculated and stored all $r_m(i)$'s for the current frame and want to go on to the next frame, which starts at sample $s(m+L)$. After the hybrid window is shifted to the right by L samples, the new window-weighted signal for the next frame becomes $$s_{m+L}(n) = s(n)w_{m+L}(n) = \begin{cases} s(n)f_{m+L}(n) = s(n)f_m(n)\alpha^L, & \text{if } n \leqq m+L-N-1 \\ s(n)g_{m+L}(n) = -s(n)\sin[c(n-m-L)], & \text{if } m+L-N \leqq n \leqq m+L-1 \\ 0, & \text{if } n \geqq m+L. \end{cases} \quad (8)$$

The recursive component of $R_{m+L}(i)$ can be written as $$\begin{aligned} r_{m+L}(i) &= \sum_{n=-\infty}^{m+L-N-1} s_{m+L}(n)s_{m+L}(n-i) \quad (9) \\ &= \sum_{n=-\infty}^{m-N-1} s_{m+L}(n)s_{m+L}(n-i) + \sum_{n=m-N}^{m+L-N-1} s_{m+L}(n)s_{m+L}(n-i) \\ &= \sum_{n=-\infty}^{m-N-1} s(n)f_m(n)\alpha^L s(n)f_m(n-i)\alpha^L + \end{aligned}$$

-continued $$\sum_{n=m-N}^{m+L-N-1} s_{m+L}(n)s_{m+L}(n-i)$$

or $$r_{m+L}(i) = \alpha^{2L} r_m(i) + \sum_{n=m-N}^{m+L-N-1} s_{m+L}(n)s_{m+L}(n-i). \quad (10)$$

Therefore, $r_{m+L}(i)$ can be calculated recursively from $r_m(i)$ using Eq. (10). This newly calculated $r_{m+L}(i)$ is stored back to memory for use in the following frame. The autocorrelation coefficient $R_{m+L}(i)$ is then obtained as $$R_{m+L}(i) = r_{m+L}(i) + \sum_{n=m+L-N}^{m+L-1} s_{m+L}(n)s_{m+L}(n-i). \quad (11)$$

Note that the autocorrelation calculation procedure described above does not depend on the shape of the non-recursive part of the hybrid window. In other words, any other function can be used for that part. The sine function we used may not be the best possible choice; We chose it only for its simplicity and for its similarity to the shape of Barnwell's recursive window.

With proper scaling, the second terms on the right-hand side of Eqs. (10) and (11) represents 16-bit by 16-bit multiply-accumulate, while the first term of Eq. (10) is a 16-bit by 32-bit multiplication if the constant $\alpha^{2L}$ is represented by 16 bits. Note that this 16-bit by 32-bit multiplication can be replaced by a k-bit accumulator shift followed by a subtraction if we choose $\alpha^{2L}=(2^k-1)/2^k$, or by a single k-bit accumulator shift if we choose $\alpha^{2L}=\frac{1}{2}^k$ for a large L. In any case, this hybrid windowing method can be implemented without using 32-bit by 32-bit double precision arithmetic. Furthermore, when compared with the original recursive windowing method, this hybrid windowing method saves about 20% to 30% of the number of multiply-adds required for calculating the autocorrelation coefficients.

Since the shapes of Barnwell's recursive window and the new hybrid window are quite similar, the two windows give quite comparable prediction gains.

Figure 9:
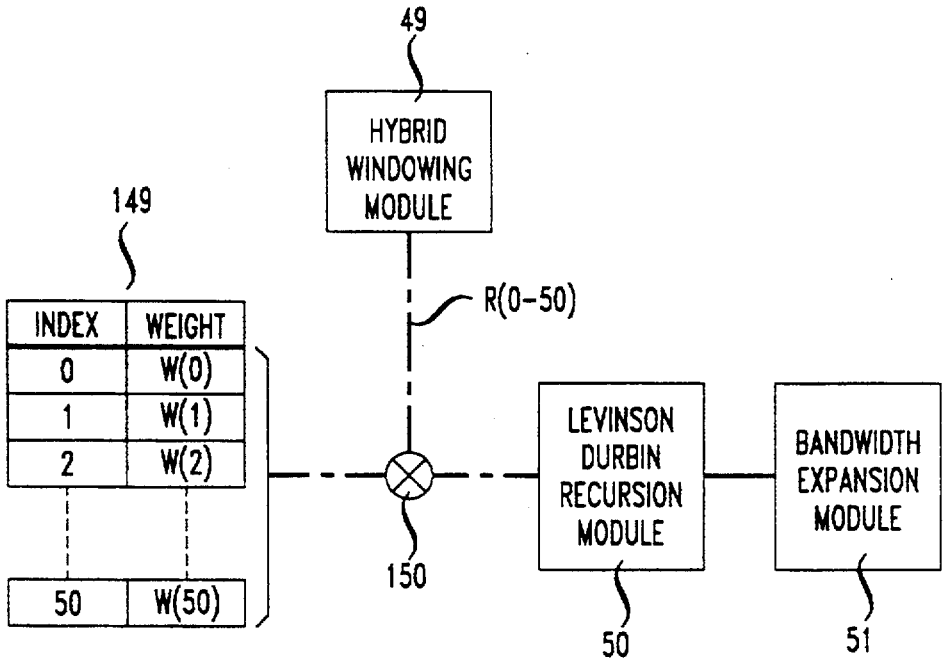
FIG. 9 is a schematic block diagram of a preprocessor to the Durbin recursion functionality of a Phase 2 System to avoid certain adverse affects arising from particular sustained speech or speech-like signals.

FIG. 9 shows the arrangements for the weighting of the correlation coefficients $R_m(i)$ to avoid the prolonged vowel sound anomaly noted earlier.

Figure 5:
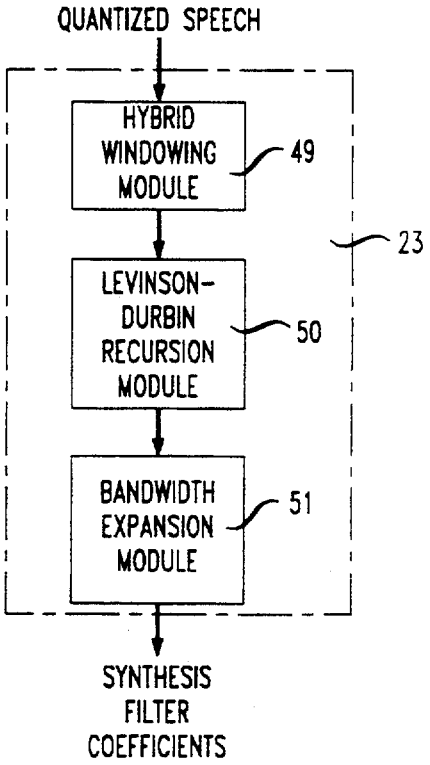
FIG. 5 is a schematic block diagram of a backward synthesis filter adapter for use in a Phase 2 System in accordance with an illustrative embodiment of the present invention.

In particular, the normal Phase 2 System processing indicated in FIG. 5, is modified in FIG. 9 to include the weighting in multiplier 150 of the autocorrelation coefficients provided in the manner described above by the hybrid windowing module 49. The weighting values are stored in a memory 149 after being calculated using any one of a number of weighting windows extending over the range of R(1) through R(50). Recall that the weight for R(0) had been previously determined as 257/256 for ease in modifying the power level and, in effect, introducing the desired level of white noise into the LPC spectrum. This weighting value is also included in the table memory 149 in FIG. 9. The other values, as noted, are conveniently calculated and stored in the same table. One convenient weighting function that has proved useful in determining the weighting values for R(1) through R(50) is that described in the above-referenced paper by Y. Tohkura, et al. In particular, the binomial or Gaussian window given by $$W(T) = e^{-\frac{(W0T)2}{2}}$$

have proved convenient. In operation the stored weight for a current frame are applied to the respective autocorrelation coefficients to form modified autocorrelation coefficient given by $R'(i)=W(i)*R(i)$, $i=0,1,2,\ldots,50$. The Tohkura reference is incorporated by reference as if set forth in its entirety to avoid the need for a detailed description of the well-known methodology for populating the weight values of memory 149. While the above description has been presented in terms of the CCITT Phase 1 and Phase 2 Systems, it should be understood that the windowing functionality and associated methods described herein have applicability beyond such particular classes of systems. Further, though the emphasis has been on processing using fixed point processors, no such limitation is fundamental to the present invention. Likewise, while the particular program codes presented in the Draft Recommendation incorporated by reference and attached as Appendix 1, or any particular processors mentioned in the cited references or incorporated by reference may offer advantages in some implementations, those skilled in the art will recognize that other particular codes or processors will be useful in practicing the invention in accordance with the teachings of the overall disclosure.

Appendix 1

CCITT

Temporary Document 62 (XV/2)

STUDY GROUP XV

Geneva, 11-22 November 1991

Question: 21

Source: Special Rapporteur (S. Dimolitsas, COMSAT -USA)

Title: Draft Recommendation on 16 kbit/s Voice Coding

Attached is a draft recommendation on 16 kbit/s Speech Coding. This draft recommendation comprises the description of the 16 kbit/s Low-Delay Code Excited Linear Prediction (LD-CELP) algorithm and an Appendix comprising procedures applicable to the implementation verification of the algorithm in floating point version.

Question 21/XV intends to add a number of appendices to this recommendation as follows:

- An Appendix related to the network aspects of 16 kbit/s LD-CELP Coding;
- An Appendix consisting of an interoperable fixed-point description of the 16 kbit/s LD-CELP algorithm; and
- An Appendix comprising procedures applicable to the implementation verification of a fixed-point algorithm version.

Draft Recommendation G.

Coding of Speech at 16 kbit/s
Using
Low-Delay Code Excited Linear Prediction (LD-CELP)

1. INTRODUCTION

This recommendation contains the description of an algorithm for the coding of speech signals at 16 kbit/s using Low-Delay Code Excited Linear Prediction (LD-CELP). This recommendation is organized as follows.

In Section 2 a brief outline of the LD-CELP algorithm is given. In Sections 3 and 4, the LD-CELP encoder and LD-CELP decoder principles are discussed, respectively. In Section 5, the computational details pertaining to each functional algorithmic block are defined. Annexes A, B, C and D contain tables of constants used by the LD-CELP algorithm. In Annex E the sequencing of variable adaptation and use is given. Finally, in Appendix I procedures applicable to the implementation verification of the algorithm are provided.

Under further study is the future incorporation of three additional appendices (to be published separately) consisting of LD-CELP network aspects, LD-CELP fixed-point implementation description, and LD-CELP fixed-point verification procedures.

2. OUTLINE OF LD-CELP

The LD-CELP algorithm consists of an encoder and a decoder described in Sections 2.1 and 2.2 respectively.

The essence of CELP techniques, which is an analysis-by-synthesis approach to codebook search, is retained in LD-CELP. The LD-CELP however, uses backward adaptation of predictors and gain to achieve an algorithmic delay of 0.625 ms. Only the index to the excitation codebook is transmitted. The predictor coefficients are updated through LPC analysis of previously quantized speech. The excitation gain is updated by using the gain information embedded in the previously quantized excitation. The block size for the excitation vector and gain adaptation is 5 samples only. A perceptual weighting filter is updated using LPC analysis of the unquantized speech.

*2.1 LD-CELP Encoder*

After the conversion from A-law or μ-law PCM to uniform PCM, the input signal is partitioned into blocks of 5 consecutive input signal samples. For each input block, the encoder passes each of 1024 candidate codebook vectors (stored in an excitation codebook) through a gain scaling unit and a synthesis filter. From the resulting 1024 candidate quantized signal vectors, the encoder identifies the one that minimizes a frequency-weighted mean-squared error measure with respect to the input signal vector. The 10-bit codebook index of the corresponding best codebook vector (or "codevector") which gives rise to that best candidate quantized signal vector is transmitted to the decoder. The best codevector is then passed through the gain scaling unit and the synthesis filter to establish the correct filter memory in preparation for the encoding of the next signal vector. The synthesis filter coefficients and the gain are updated periodically in a backward adaptive manner based on the previously quantized signal and gain-scaled excitation.

*2.2 LD-CELP Decoder*

The decoding operation is also performed on a block-by-block basis. Upon receiving each 10-bit index, the decoder performs a table look-up to extract the corresponding codevector from the excitation codebook. The extracted codevector is then passed through a gain scaling unit and a synthesis filter to produce the current decoded signal vector. The synthesis filter coefficients and the gain are then updated in the same way as in the encoder. The decoded signal vector is then passed through an adaptive postfilter to enhance the perceptual quality. The postfilter coefficients are updated periodically using the information available at the decoder. The 5 samples of the postfilter signal vector are next converted to 5 A-law or μ-law PCM output samples.

3. LD-CELP ENCODER PRINCIPLES

Figure 2 is a detailed block schematic of the LD-CELP encoder. The encoder in Fig. 2 is mathematically equivalent to the encoder previously shown in Fig. 1 but is computationally more efficient to implement.

In the following description,

1. For each variable to be described, $k$ is the sampling index and samples are taken at 125 μs intervals.
2. A group of 5 consecutive samples in a given signal is called a vector of that signal. For example, 5 consecutive speech samples form a speech vector, 5 excitation samples form an excitation vector, and so on.
3. We use $n$ to denote the vector index, which is different from the sample index $k$.
4. Four consecutive vectors build one adaptation cycle. In a later section, we also refer to adaptation cycles as frames. The two terms are used interchangably.

The excitation Vector Quantization (VQ) codebook index is the only information explicitly transmitted from the encoder to the decoder. Three other types of parameters will be periodically updated: (1) the excitation gain, (2) the synthesis filter coefficients, and (3) the perceptual weighting filter coefficients. These parameters are derived in a backward adaptive manner from signals that occur prior to the current signal vector. The excitation gain is updated once per vector, while the synthesis filter coefficients and the perceptual weighting filter coefficients are updated once every 4 vectors (i.e., a 20-sample, or 2.5 ms update period). Note that although the processing sequence in the algorithm has an adaptation cycle of 4 vectors (20 samples), the basic buffer size is still only 1 vector (5 samples). This small buffer size makes it possible to achieve a one-way delay less than 2 ms.

A description of each block of the encoder is given below. Since the LD-CELP coder is mainly used for encoding speech, for convenience of description, in the following we will assume that the input signal is speech, although in practice it can be other non-speech signals as well.

*3.1 Input PCM Format Conversion*

This block converts the input A-law or μ-law PCM signal $s_o(k)$ to a uniform PCM signal $s_u(k)$.

*3.1.1 Internal Linear PCM Levels*

In converting from $A$-law or μ-law to linear PCM, different internal representations are possible, depending on the device. For example, standard tables for μ-law PCM define a linear range of -4015.5 to +4015.5. The corresponding range for $A$-law PCM is -2016 to +2016. Both tables list some output values having a fractional part of 0.5. These fractional parts cannot be represented in an integer device unless the entire table is multiplied by 2 to make all of the values integers. In fact, this is what is most commonly done in fixed point DSP chips. On the other hand, floating point DSP chips can represent the same values listed in the tables. Throughout this document it is assumed that the input signal has a maximum range of -4095 to +4095. This encompasses both the μ-law and $A$-law cases. In the case of $A$-law it implies that when the linear conversion results in a range of -2016 to +2016, those values should be scaled up by a factor of 2 before continuing to encode the signal. In the case of μ-law input to a fixed point processor where the input range is converted to -8031 to +8031, it implies that values should be scaled down by a factor of 2 before beginning the encoding process. Alternatively, these values can be treated as being in Q1 format, meaning there is 1 bit to the right of the decimal point. All computation involving the data would then need to take this bit into account.

For the case of 16-bit linear PCM input signals having the full dynamic range of -32768 to +32767, the input values should be considered to be in Q3 format. This means that the input values should be scaled down (divided) by a factor of 8. On output at the decoder the factor of 8 would be restored for these signals.

*3.2 Vector Buffer*

This block buffers 5 consecutive speech samples $s_u(5n)$, $s_u(5n+1)$, ..., $s_u(5n+4)$ to form a 5-dimensional speech vector $s(n) = [s_u(5n), s_u(5n+1), \cdots, s_u(5n+4)]$.

*3.3 Adapter for Perceptual Weighting Filter*

Figure 4 shows the detailed operation of the perceptual weighting filter adapter (block 3 in Fig. 2). This adapter calculates the coefficients of the perceptual weighting filter once every 4 speech vectors based on linear prediction analysis (often referred to as LPC analysis) of unquantized speech. The coefficient updates occur at the third speech vector of every 4-vector adaptation cycle. The coefficients are held constant in between updates.

Refer to Fig. 4 (a). The calculation is performed as follows. First, the input (unquantized) speech vector is passed through a hybrid windowing module (block 36) which places a window on previous speech vectors and calculates the first 11 autocorrelation coefficients of the windowed speech signal as the output. The Levinson-Durbin recursion module (block 37) then converts these autocorrelation coefficients to predictor coefficients. Based on these predictor coefficients, the weighting filter coefficient calculator (block 38) derives the desired coefficients of the weighting filter. These three blocks are discussed in more detail below.

First, let us describe the principles of hybrid windowing. Since this hybrid windowing technique will be used in three different kinds of LPC analyses, we first give a more general description of the technique and then specialize it to different cases. Suppose the LPC analysis is to be performed once every $L$ signal samples. To be general, assume that the signal samples corresponding to the current LD-CELP adaptation cycle are $s_u(m)$, $s_u(m+1)$, $s_u(m+2)$, ..., $s_u(m+L-1)$. Then, for backward-adaptive LPC analysis, the hybrid window is applied to all previous signal samples with a sample index less than $m$ (as shown in Fig. 4 (b)). Let there be $N$ non-recursive samples in the hybrid window function. Then, the signal samples $s_u(m-1)$, $s_u(m-2)$, ..., $s_u(m-N)$ are all weighted by the non-recursive portion of the window. Starting with $s_u(m-N-1)$, all signal samples to the left of (and including) this sample are weighted by the recursive portion of the window, which has values $b, b\alpha, b\alpha^2$, ..., where $0 < b < 1$ and $0 < \alpha < 1$.

At time $m$, the hybrid window function $w_m(k)$ is defined as $$w_m(k) = \begin{cases} f_m(k) = b\alpha^{-[k-(m-N-1)]}, & \text{if } k \le m-N-1 \\ g_m(k) = -\sin[c(k-m)], & \text{if } m-N \le k \le m-1 \\ 0, & \text{if } k \ge m \end{cases}, \tag{1a}$$

and the window-weighted signal is $$s_m(k) = s_u(k)w_m(k) = \begin{cases} s_u(k)f_m(k) = s_u(k)b\alpha^{-[k-(m-N-1)]}, & \text{if } k \le m-N-1 \\ s_u(k)g_m(k) = -s_u(k)\sin[c(k-m)], & \text{if } m-N \le k \le m-1 \\ 0, & \text{if } k \ge m \end{cases}. \tag{1b}$$

The samples of non-recursive portion $g_m(k)$ and the initial section of the recursive portion $f_m(k)$ for different hybrid windows are specified in Appendix A. For an $M$-th order LPC analysis, we need to calculate $M+1$ autocorrelation coefficients $R_m(i)$ for $i = 0, 1, 2, ..., M$. The $i$-th autocorrelation coefficient for the current adaptation cycle can be expressed as $$R_m(i) = \sum_{k=-\infty}^{m-1} s_m(k)s_m(k-i) = r_m(i) + \sum_{k=m-N}^{m-1} s_m(k)s_m(k-i), \tag{1c}$$

where $$r_m(i) = \sum_{k=-\infty}^{m-N-1} s_m(k)s_m(k-i) = \sum_{k=-\infty}^{m-N-1} s_u(k)s_u(k-i)f_m(k)f_m(k-i). \tag{1d}$$

On the right-hand side of Eq. (1c), the first term $r_m(i)$ is the "recursive component" of $R_m(i)$, while the second term is the "non-recursive component". The finite summation of the non-recursive component is calculated for each adaptation cycle. On the other hand, the recursive component is calculated recursively. The following paragraphs explain how.

Suppose we have calculated and stored all $r_m(i)$'s for the current adaptation cycle and want to go on to the next adaptation cycle, which starts at sample $s_u(m+L)$. After the hybrid window is shifted to the right by $L$ samples, the new window-weighted signal for the next adaptation cycle becomes $$s_{m+L}(k) = s_u(k)w_{m+L}(k) = \begin{cases} s_u(k)f_{m+L}(k) = s_u(k)f_m(k)\alpha^L, & \text{if } k \le m+L-N-1 \\ s_u(k)g_{m+L}(k) = -s_u(k)\sin[c(k-m-L)], & \text{if } m+L-N \le k \le m+L-1 \\ 0, & \text{if } k \ge m+L \end{cases} \quad (1e)$$

The recursive component of $R_{m+L}(i)$ can be written as $$\begin{aligned} r_{m+L}(i) &= \sum_{k=-\infty}^{m+L-N-1} s_{m+L}(k)s_{m+L}(k-i) \\ &= \sum_{k=-\infty}^{m-N-1} s_{m+L}(k)s_{m+L}(k-i) + \sum_{k=m-N}^{m+L-N-1} s_{m+L}(k)s_{m+L}(k-i) \\ &= \sum_{k=-\infty}^{m-N-1} s_u(k)f_m(k)\alpha^L s_u(k)f_m(k-i)\alpha^L + \sum_{k=m-N}^{m+L-N-1} s_{m+L}(k)s_{m+L}(k-i) \end{aligned} \quad (1f)$$

or $$r_{m+L}(i) = \alpha^{2L} r_m(i) + \sum_{k=m-N}^{m+L-N-1} s_{m+L}(k)s_{m+L}(k-i) . \quad (1g)$$

Therefore, $r_{m+L}(i)$ can be calculated recursively from $r_m(i)$ using Eq. (1g). This newly calculated $r_{m+L}(i)$ is stored back to memory for use in the following adaptation cycle. The autocorrelation coefficient $R_{m+L}(i)$ is then calculated as $$R_{m+L}(i) = r_{m+L}(i) + \sum_{k=m+L-N}^{m+L-1} s_{m+L}(k)s_{m+L}(k-i) . \quad (1h)$$

So far we have described in a general manner the principles of hybrid window calculation procedure. The parameter values for the hybrid windowing module 36 in Fig. 4 (a) are $M = 10$, $L = 20$, $N = 30$, and $\alpha = \left(\frac{1}{2}\right)^{\frac{1}{40}} = 0.982820598$ (so that $\alpha^{2L} = \frac{1}{2}$).

Once the 11 autocorrelation coefficients $R(i)$, $i = 0, 1, \ldots, 10$ are calculated by the hybrid windowing procedure described above, a "white noise correction" procedure is applied. This is done by increasing the energy $R(0)$ by a small amount:

$$R(0) \leftarrow \left(\frac{257}{256}\right) R(0) \quad (1i)$$

This has the effect of filling the spectral valleys with white noise so as to reduce the spectral dynamic range and alleviate ill-conditioning of the subsequent Levinson-Durbin recursion. The white noise correction factor (WNCF) of 257/256 corresponds to a white noise level about 24 dB below the average speech power.

Next, using the white noise corrected autocorrelation coefficients, the Levinson-Durbin recursion module 37 recursively computes the predictor coefficients from order 1 to order 10. Let the $j$-th coefficients of the $i$-th order predictor be $a_j^{(i)}$. Then, the recursive procedure can be specified as follows:

$$E(0) = R(0) \quad (2a)$$

$$k_i = -\frac{R(i) + \sum_{j=1}^{i-1} a_j^{(i-1)} R(i-j)}{E(i-1)} \quad (2b)$$

$$a_i^{(i)} = k_i \quad (2c)$$

$$a_j^{(i)} = a_j^{(i-1)} + k_i a_{i-j}^{(i-1)} , \quad 1 \le j \le i-1 \quad (2d)$$

$$E(i) = (1 - k_i^2)E(i-1) . \quad (2e)$$

Equations (2b) through (2e) are evaluated recursively for $i = 1, 2, ..., 10$, and the final solution is given by $$q_i = a_i^{(10)}, \quad 1 \le i \le 10. \tag{2f}$$

If we define $q_0 = 1$, then the 10-th order "prediction-error filter" (sometimes called "analysis filter") has the transfer function $$\tilde{Q}(z) = \sum_{i=0}^{10} q_i z^{-i}, \tag{3a}$$

and the corresponding 10-th order linear predictor is defined by the following transfer function $$Q(z) = -\sum_{i=1}^{10} q_i z^{-i}. \tag{3b}$$

The weighting filter coefficient calculator (block 38) calculates the perceptual weighting filter coefficients according to the following equations:

$$W(z) = \frac{1 - Q(z/\gamma_1)}{1 - Q(z/\gamma_2)}, \quad 0 < \gamma_2 < \gamma_1 \le 1, \tag{4a}$$

$$Q(z/\gamma_1) = -\sum_{i=1}^{10} (q_i \gamma_1^i) z^{-i}, \tag{4b}$$

and $$Q(z/\gamma_2) = -\sum_{i=1}^{10} (q_i \gamma_2^i) z^{-i}. \tag{4c}$$

The perceptual weighting filter is a 10-th order pole-zero filter defined by the transfer function $W(z)$ in Eq. (4a). The values of $\gamma_1$ and $\gamma_2$ are 0.9 and 0.6, respectively.

Now refer to Fig. 2. The perceptual weighting filter adapter (block 3) periodically updates the coefficients of $W(z)$ according to Eqs. (2) through (4), and feeds the coefficients to the impulse response vector calculator (block 12) and the perceptual weighting filters (blocks 4 and 10).

*3.4 Perceptual Weighting Filter*

In Fig. 2, the current input speech vector $s(n)$ is passed through the perceptual weighting filter (block 4), resulting in the weighted speech vector $v(n)$. Note that except during initialization, the filter memory (i.e., internal state variables, or the values held in the delay units of the filter) should not be reset to zero at any time. On the other hand, the memory of the perceptual weighting filter (block 10) will need special handling as described later.

*3.4.1 Non-speech Operation*

For modem signals or other non-speech signals, CCITT test results indicate that it is desirable to disable the perceptual weighting filter. This is equivalent to setting $W(z)=1$. This can most easily be accomplished if $\gamma_1$ and $\gamma_2$ in Equation (4a) are set equal to zero. The nominal values for these variables in speech mode are 0.9 and 0.6, respectively.

*3.5 Synthesis Filter*

In Fig. 2, there are two synthesis filters (blocks 9 and 22) with identical coefficients. Both filters are updated by the backward synthesis filter adapter (block 23). Each synthesis filter is a 50-th order all-pole filter that consists of a feedback loop with a 50-th order LPC predictor in the feedback branch. The transfer function of the synthesis filter is $F(z) = 1/[1 - P(z)]$, where $P(z)$ is the transfer function of the 50-th order LPC predictor.

After the weighted speech vector $v(n)$ has been obtained, a zero-input response vector $r(n)$ will be generated using the synthesis filter (block 9) and the perceptual weighting filter (block 10). To accomplish this, we first open the switch 5, i.e., point it to node 6. This implies that the signal going from node 7 to the synthesis filter 9 will be zero. We then let the synthesis filter 9 and the perceptual weighting filter 10 "ring" for 5 samples (1 vector). This means that we continue the filtering operation for 5 samples with a zero signal applied at node 7. The resulting output of the perceptual weighting filter 10 is the desired zero-input response vector $r(n)$.

Note that except for the vector right after initialization, the memory of the filters 9 and 10 is in general non-zero; therefore, the output vector $r(n)$ is also non-zero in general, even though the filter input from node 7 is zero. In effect, this vector $r(n)$ is the response of the two filters to previous gain-scaled excitation vectors $e(n-1)$, $e(n-2)$, ... This vector actually represents the effect due to filter memory up to time $(n-1)$.

*3.6 VQ Target Vector Computation*

This block subtracts the zero-input response vector $r(n)$ from the weighted speech vector $v(n)$ to obtain the VQ codebook search target vector $x(n)$.

*3.7 Backward Synthesis Filter Adapter*

This adapter 23 updates the coefficients of the synthesis filters 9 and 22. It takes the quantized (synthesized) speech as input and produces a set of synthesis filter coefficients as output. Its operation is quite similar to the perceptual weighting filter adapter 3.

A blown-up version of this adapter is shown in Fig. 5. The operation of the hybrid windowing module 49 and the Levinson-Durbin recursion module 50 is exactly the same as their counter parts (36 and 37) in Fig. 4 (a), except for the following three differences:

1. The input signal is now the quantized speech rather than the unquantized input speech.
2. The predictor order is 50 rather than 10.
3. The hybrid window parameters are different: $N = 35$, $\alpha = \left(\frac{3}{4}\right)^{\frac{1}{40}} = 0.992833749$.

Note that the update period is still $L = 20$, and the white noise correction factor is still 257/256 = 1.00390625.

Let $\hat{P}(z)$ be the transfer function of the 50-th order LPC predictor, then it has the form $$\hat{P}(z) = -\sum_{i=1}^{50} \hat{a}_i z^{-i}, \tag{5}$$

where $\hat{a}_i$'s are the predictor coefficients. To improve robustness to channel errors, these coefficients are modified so that the peaks in the resulting LPC spectrum have slightly larger bandwidths. The bandwidth expansion module 51 performs this bandwidth expansion procedure in the following way. Given the LPC predictor coefficients $\hat{a}_i$'s, a new set of coefficients $a_i$'s is computed according to $$a_i = \lambda^i \hat{a}_i, \quad i = 1, 2, \ldots, 50, \tag{6}$$

where $\lambda$ is given by $$\lambda = \frac{253}{256} = 0.98828125 \quad . \tag{7}$$

This has the effects of moving all the poles of the synthesis filter radially toward the origin by a factor of $\lambda$. Since the poles are moved away from the unit circle, the peaks in the frequency response are widened.

After such bandwidth expansion, the modified LPC predictor has a transfer function of $$P(z) = -\sum_{i=1}^{50} a_i z^{-i}. \tag{8}$$

The modified coefficients are then fed to the synthesis filters 9 and 22. These coefficients are also fed to the impulse response vector calculator 12.

The synthesis filters 9 and 22 both have a transfer function of $$F(z) = \frac{1}{1 - P(z)} \quad . \tag{9}$$

Similar to the perceptual weighting filter, the synthesis filters 9 and 22 are also updated once every 4 vectors, and the updates also occur at the third speech vector of every 4-vector adaptation cycle. However, the updates are based on the quantized speech up to the last vector of the previous adaptation cycle. In other words, a delay of 2 vectors is introduced before the updates take place. This is because the Levinson-Durbin recursion module 50 and the energy table calculator 15 (described later) are computationally intensive. As a result, even though the autocorrelation of previously quantized speech is available at the first vector of each 4-vector cycle, computations may require more than one vector worth of time. Therefore, to maintain a basic buffer size of 1 vector (so as to keep the coding delay low), and to maintain real-time operation, a 2-vector delay in filter updates is introduced in order to facilitate real-time implementation.

*3.8 Backward Vector Gain Adapter*

This adapter updates the excitation gain $\sigma(n)$ for every vector time index $n$. The excitation gain $\sigma(n)$ is a scaling factor used to scale the selected excitation vector $y(n)$. The adapter 20 takes the gain-scaled excitation vector $e(n)$ as its input, and produces an excitation gain $\sigma(n)$ as its output. Basically, it attempts to "predict" the gain of $e(n)$ based on the gains of $e(n-1)$, $e(n-2)$, ... by using adaptive linear prediction in the logarithmic gain domain. This backward vector gain adapter 20 is shown in more detail in Fig. 6.

Figure 6:
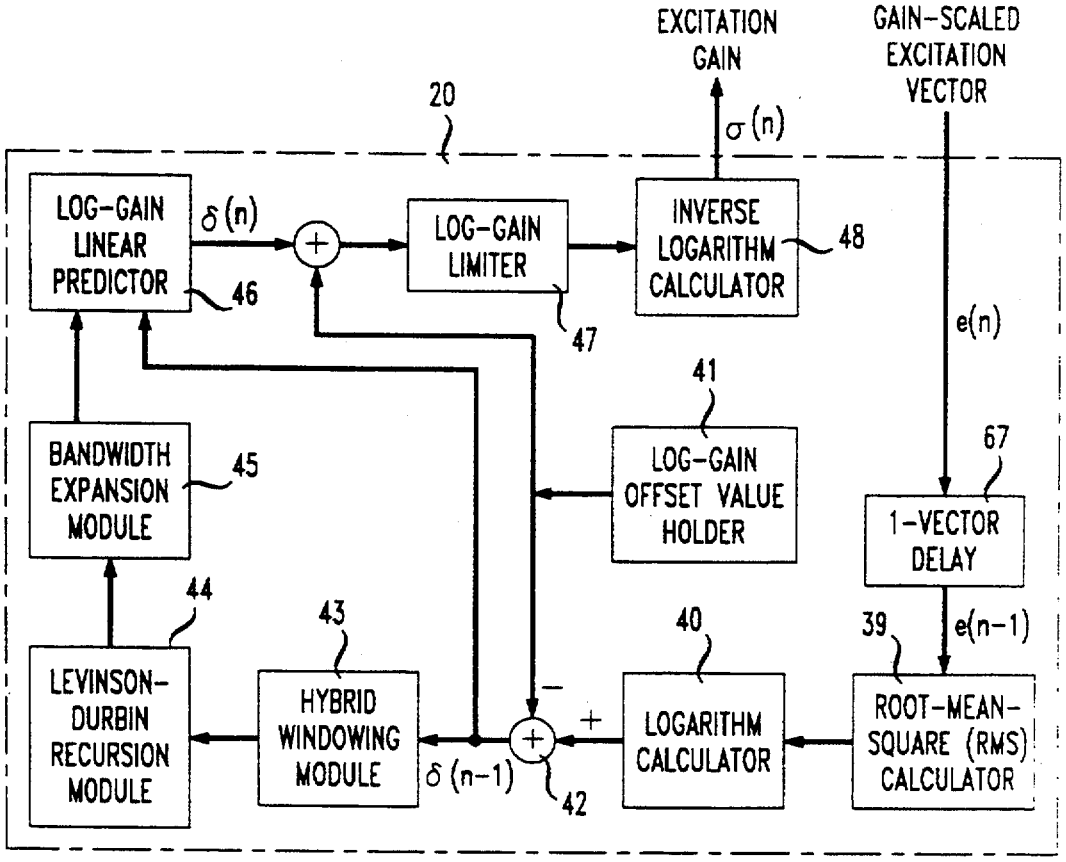
FIG. 6 is a schematic block diagram of a backward vector gain adapter for use in a Phase 2 System in accordance with an illustrative embodiment of the present invention.

Refer to Fig. 6. This gain adapter operates as follows. The 1-vector delay unit 67 makes the previous gain-scaled excitation vector $e(n-1)$ available. The Root-Mean-Square (RMS) calculator 39 then calculates the RMS value of the vector $e(n-1)$. Next, the logarithm calculator 40 calculates the dB value of the RMS of $e(n-1)$, by first computing the base 10 logarithm and then multiplying the result by 20.

In Fig. 6, a log-gain offset value of 32 dB is stored in the log-gain offset value holder 41. This values is meant to be roughly equal to the average excitation gain level (in dB) during voiced speech. The adder 42 subtracts this log-gain offset value from the logarithmic gain produced by the logarithm calculator 40. The resulting offset-removed logarithmic gain $\delta(n-1)$ is then used by the hybrid windowing module 43 and the Levinson-Durbin recursion module 44. Again, blocks 43 and 44 operate in exactly the same way as blocks 36 and 37 in the perceptual weighting filter adapter module (Fig. 4 (a)), except that the hybrid window parameters are different and that the signal under analysis is now the offset-removed logarithmic gain rather than the input speech. (Note that only one gain value is produced for every 5 speech samples.) The hybrid window parameters of block 43 are $M = 10, N = 20, L = 4, \alpha = \left(\frac{3}{4}\right)^{\frac{1}{8}} = 0.96467863$.

The output of the Levinson-Durbin recursion module 44 is the coefficients of a 10-th order linear predictor with a transfer function of $$\hat{R}(z) = -\sum_{i=1}^{10} \hat{\alpha}_i z^{-i} . \tag{10}$$

The bandwidth expansion module 45 then moves the roots of this polynomial radially toward the z-plane original in a way similar to the module 51 in Fig. 5. The resulting bandwidth-expanded gain predictor has a transfer function of $$R(z) = -\sum_{i=1}^{10} \alpha_i z^{-i} , \tag{11}$$

where the coefficients $\alpha_i$'s are computed as $$\alpha_i = \left(\frac{29}{32}\right)^i \hat{\alpha}_i = (0.90625)^i \hat{\alpha}_i . \tag{12}$$

Such bandwidth expansion makes the gain adapter (block 20 in Fig. 2) more robust to channel errors. These $\alpha_i$'s are then used as the coefficients of the log-gain linear predictor (block 46 of Fig. 6).

This predictor 46 is updated once every 4 speech vectors, and the updates take place at the second speech vector of every 4-vector adaptation cycle. The predictor attempts to predict $\delta(n)$ based on a linear combination of $\delta(n-1)$, $\delta(n-2)$, ..., $\delta(n-10)$. The predicted version of $\delta(n)$ is denoted as $\hat{\delta}(n)$ and is given by $$\hat{\delta}(n) = -\sum_{i=1}^{10} \alpha_i \delta(n-i) . \tag{13}$$

After $\hat{\delta}(n)$ has been produced by the log-gain linear predictor 46, we add back the log-gain offset value of 32 dB stored in 41. The log-gain limiter 47 then check the resulting log-gain value and clip it if the value is unreasonably large or unreasonably small. The lower and upper limits are set to 0 dB and 60 dB, respectively. The gain limiter output is then fed to the inverse logarithm calculator 48, which reverses the operation of the logarithm calculator 40 and converts the gain from the dB value to the linear domain. The gain limiter ensures that the gain in the linear domain is in between 1 and 1000.

*3.9 Codebook Search Module*

In Fig. 2, blocks 12 through 18 constitute a codebook search module 24. This module searches through the 1024 candidate codevectors in the excitation VQ codebook 19 and identifies the index of the best codevector which gives a corresponding quantized speech vector that is closest to the input speech vector.

To reduce the codebook search complexity, the 10-bit, 1024-entry codebook is decomposed into two smaller codebooks: a 7-bit "shape codebook" containing 128 independent codevectors and a 3-bit "gain codebook" containing 8 scalar values that are symmetric with respect to zero (i.e., one bit for sign, two bits for magnitude). The final output codevector is the product of the best shape codevector (from the 7-bit shape codebook) and the best gain level (from the 3-bit gain codebook). The 7-bit shape codebook table is given in Appendix B, and the 3-bit gain codebook table is given in the first row of Table 3 in Section 5.

*3.9.1 Principle of Codebook Search*

In principle, the codebook search module 24 scales each of the 1024 candidate codevectors by the current excitation gain $\sigma(n)$ and then passes the resulting 1024 vectors one at a time through a cascaded filter consisting of the synthesis filter $F(z)$ and the perceptual weighting filter $W(z)$. The filter memory is initialized to zero each time the module feeds a new codevector to the cascaded filter with transfer function $H(z)=F(z)W(z)$.

The filtering of VQ codevectors can be expressed in terms of matrix-vector multiplication. Let $y_j$ be the $j$-th codevector in the 7-bit shape codebook, and let $g_i$ be the $i$-th levels in the 3-bit gain codebook. Let $\{h(n)\}$ denote the impulse response sequence of the cascaded filter. Then, when the codevector specified by the codebook indices $i$ and $j$ is fed to the cascaded filter $H(z)$, the filter output can be expressed as $$\tilde{x}_{ij} = \mathbf{H}\sigma(n)g_i y_j \quad , \tag{14}$$

where $$\mathbf{H} = \begin{bmatrix} h(0) & 0 & 0 & 0 & 0 \\ h(1) & h(0) & 0 & 0 & 0 \\ h(2) & h(1) & h(0) & 0 & 0 \\ h(3) & h(2) & h(1) & h(0) & 0 \\ h(4) & h(3) & h(2) & h(1) & h(0) \end{bmatrix} . \tag{15}$$

The codebook search module 24 searches for the best combination of indices $i$ and $j$ which minimizes the following Mean-Squared Error (MSE) distortion.

$$D = \| x(n) - \tilde{x}_{ij} \|^2 = \sigma^2(n) \| \hat{x}(n) - g_i \mathbf{H} y_j \|^2 \ , \tag{16}$$

where $\hat{x}(n) = x(n)/\sigma(n)$ is the gain-normalized VQ target vector. Expanding the terms gives us $$D = \sigma^2(n)\left[ \| \hat{x}(n) \|^2 - 2g_i \hat{x}^T(n)\mathbf{H}y_j + g_i^2 \| \mathbf{H}y_j \|^2 \right] . \tag{17}$$

Since the term $\| \hat{x}(n) \|^2$ and the value of $\sigma^2(n)$ are fixed during the codebook search, minimizing $D$ is equivalent to minimizing $$\hat{D} = -2g_i p^T(n) y_j + g_i^2 E_j \quad , \tag{18}$$

where $$p(n) = \mathbf{H}^T \hat{x}(n) \ , \tag{19}$$

and $$E_j = \| \mathbf{H}y_j \|^2 . \tag{20}$$

Note that $E_j$ is actually the energy of the $j$-th filtered shape codevectors and does not depend on the VQ target vector $\hat{x}(n)$. Also note that the shape codevector $y_j$ is fixed, and the matrix $\mathbf{H}$ only depends on the synthesis filter and the weighting filter, which are fixed over a period of 4 speech vectors. Consequently, $E_j$ is also fixed over a period of 4 speech vectors. Based on this observation, when the two filters are updated, we can compute and store the 128 possible energy terms $E_j$, $j = 0, 1, 2, \ldots, 127$ (corresponding to the 128 shape codevectors) and then use these energy terms repeatedly for the codebook search during the next 4 speech vectors. This arrangement reduces the codebook search complexity.

For further reduction in computation, we can precompute and store the two arrays $$b_i = 2g_i \tag{21}$$

and $$c_i = g_i^2 \tag{22}$$

for $i = 0, 1, \ldots, 7$. These two arrays are fixed since $g_i$'s are fixed. We can now express $\hat{D}$ as $$\hat{D} = -b_i P_j + c_i E_j \quad , \tag{23}$$

where $P_j = p^T(n)y_j$.

Note that once the $E_j$, $b_i$, and $c_i$ tables are precomputed and stored, the inner product term $P_j = p^T(n)y_j$, which solely depends on $j$, takes most of the computation in determining $\hat{D}$. Thus, the codebook search procedure steps through the shape codebook and identifies the best gain index $i$ for each shape codevector $y_j$.

There are several ways to find the best gain index $i$ for a given shape codevector $y_j$.

1. The first and the most obvious way is to evaluate the 8 possible $\hat{D}$ values corresponding to the 8 possible values of $i$, and then pick the index $i$ which corresponds to the smallest $\hat{D}$. However, this requires 2 multiplications for each $i$.

2. A second way is to compute the optimal gain $\hat{g} = P_j/E_j$ first, and then quantize this gain $\hat{g}$ to one of the 8 gain levels $\{g_0, \ldots, g_7\}$ in the 3-bit gain codebook. The best index $i$ is the index of the gain level $g_i$ which is closest to $\hat{g}$. However, this approach requires a division operation for each of the 128 shape codevectors, and division is typically very inefficient to implement using DSP processors.

3. A third approach, which is a slightly modified version of the second approach, is particularly efficient for DSP implementations. The quantization of $\hat{g}$ can be thought of as a series of comparisons between $\hat{g}$ and the "quantizer cell boundaries", which are the mid-points between adjacent gain levels. Let $d_i$ be the mid-point between gain level $g_i$ and $g_{i+1}$ that have the same sign. Then, testing "$\hat{g} < d_i$?" is equivalent to testing "$P_j < d_i E_j$?". Therefore, by using the latter test, we can avoid the division operation and still require only one multiplication for each index $i$. This is the approach used in the codebook search. The gain quantizer cell boundaries $d_i$'s are fixed and can be precomputed and stored in a table. For the 8 gain levels, actually only 6 boundary values $d_0, d_1, d_2, d_4, d_5$, and $d_6$ are used.

Once the best indices $i$ and $j$ are identified, they are concatenated to form the output of the codebook search module — a single 10-bit best codebook index.

*3.9.2 Operation of Codebook Search Module*

With the codebook search principle introduced, the operation of the codebook search module 24 is now described below. Refer to Fig. 2. Every time when the synthesis filter 9 and the perceptual weighting filter 10 are updated, the impulse response vector calculator 12 computes the first 5 samples of the impulse response of the cascaded filter $F(z)W(z)$. To compute the impulse response vector, we first set the memory of the cascaded filter to zero, then excite the filter with an input sequence $\{1, 0, 0, 0, 0\}$. The corresponding 5 output samples of the filter are $h(0), h(1), \ldots, h(4)$, which constitute the desired impulse response vector. After this impulse response vector is computed, it will be held constant and used in the codebook search for the following 4 speech vectors, until the filters 9 and 10 are updated again.

Next, the shape codevector convolution module 14 computes the 128 vectors $Hy_j$, $j = 0, 1, 2, \ldots, 127$. In other words, it convolves each shape codevector $y_j$, $j = 0, 1, 2, \ldots, 127$ with the impulse response sequence $h(0), h(1), \ldots, h(4)$, where the convolution is only performed for the first 5 samples. The energy of the resulting 128 vectors are then computed and stored by the energy table calculator 15 according to Eq. (20). The energy of a vector is defined as the sum of the squared value of each vector component.

Note that the computations in blocks 12, 14, and 15 are performed only once every 4 speech vectors, while the other blocks in the codebook search module perform computations for each speech vector. Also note that the updates of the $E_j$ table is synchronized with the updates of the synthesis filter coefficients. That is, the new $E_j$ table will be used starting from the third speech vector of every adaptation cycle (Refer to the discussion in Section 3.7.)

The VQ target vector normalization module 16 calculates the gain-normalized VQ target vector $\hat{x}(n) = x(n)/\sigma(n)$. In DSP implementations, it is more efficient to first compute $1/\sigma(n)$, and then multiply each component of $x(n)$ by $1/\sigma(n)$.

Next, the time-reversed convolution module 13 computes the vector $p(n) = H^T\hat{x}(n)$. This operation is equivalent to first reversing the order of the components of $\hat{x}(n)$, then convolving the resulting vector with the impulse response vector, and then reverse the component order of the output again (and hence the name "time-reversed convolution").

Once $E_j$, $b_i$, and $c_i$ tables are precomputed and stored, and the vector $p(n)$ is also calculated, then the error calculator 17 and the best codebook index selector 18 work together to perform the following efficient codebook search algorithm.

1. Initialize $\hat{D}_{min}$ to a number larger than the largest possible value of $\hat{D}$ (or use the largest possible number of the DSP's number representation system).

2. Set the shape codebook index $j = 0$

3. Compute the inner product $P_j = p^T(n)y_j$.

4. If $P_j < 0$, go to step 8 to search through negative gains; otherwise, proceed to step 5 to search through positive gains.

5. if $P_j < d_0E_j$, set $i = 0$ and go to step 11; otherwise proceed to step 6.

6. if $P_j < d_1E_j$, set $i = 1$ and go to step 11; otherwise proceed to step 7.

7. if $P_j < d_2E_j$, set $i = 2$ and go to step 11; otherwise set $i = 3$ and go to step 11.

8. if $P_j > d_4E_j$, set $i = 4$ and go to step 11; otherwise proceed to step 9.

9. if $P_j > d_5E_j$, set $i = 5$ and go to step 11; otherwise proceed to step 10.

10. if $P_j > d_6E_j$, set $i = 6$; otherwise set $i = 7$.

11. Compute $\hat{D} = -b_iP_j + c_iE_j$

12. If $\hat{D} < \hat{D}_{min}$, then set $\hat{D}_{min} = \hat{D}$, $i_{min} = i$, and $j_{min} = j$.

13. If $j < 127$, set $j = j + 1$ and go to step 3; otherwise proceed to step 14.

14. When the algorithm proceeds to here, all 1024 possible combinations of gains and shapes have been searched through. The resulting $i_{min}$, and $j_{min}$ are the desired channel indices for the gain and the shape, respectively. The output best codebook index (10-bit) is the concatenation of these two indices, and the corresponding best excitation codevector is $y(n) = g_{i_{min}}y_{j_{min}}$. The selected 10-bit codebook index is transmitted through the communication channel to the decoder.

*3.10 Simulated Decoder*

Although the encoder has identified and transmitted the best codebook index so far, some additional tasks have to be performed in preparation for the encoding of the following speech vectors. First, the best codebook index is fed to the excitation VQ codebook to extract the corresponding best codevector $y(n) = g_{i_{min}}y_{j_{min}}$. This best codevector is then scaled by the current excitation gain $\sigma(n)$ in the gain stage 21. The resulting gain-scaled excitation vector is $e(n) = \sigma(n)y(n)$.

This vector $e(n)$ is then passed through the synthesis filter 22 to obtain the current quantized speech vector $s_q(n)$. Note that blocks 19 through 23 form a simulated decoder 8. Hence, the quantized speech vector $s_q(n)$ is actually the simulated decoded speech vector when there is no channel errors. In Fig. 2, the backward synthesis filter adapter 23 needs this quantized speech vector $s_q(n)$ to update the synthesis filter coefficients. Similarly, the backward vector gain adapter 20 needs the gain-scaled excitation vector $e(n)$ to update the coefficients of the log-gain linear predictor.

One last task before proceeding to encode the next speech vector is to update the memory of the synthesis filter 9 and the perceptual weighting filter 10. To accomplish this, we first save the memory of filters 9 and 10 which was left over after performing the zero-input response computation described in Section 3.5. We then set the memory of filters 9 and 10 to zero and close the switch 5, i.e., connect it to node 7. Then, the gain-scaled excitation vector $e(n)$ is passed through the two zero-memory filters 9 and 10. Note that since $e(n)$ is only 5 samples long and the filters have zero memory, the number of multiply-adds only goes up from 0 to 4 for the 5-sample period. This is a significant saving in computation since there would be 70 multiply-adds per sample if the filter memory were not zero. Next, we add the saved original filter memory back to the newly established filter memory after filtering $e(n)$. This in effect adds the zero-input responses to the zero-state responses of the filters 9 and 10. This results in the desired set of filter memory which will be used to compute the zero-input response during the encoding of the next speech vector.

Note that after the filter memory update, the top 5 elements of the memory of the synthesis filter 9 are exactly the same as the components of the desired quantized speech vector $s_q(n)$. Therefore, we can actually omit the synthesis filter 22 and obtain $s_q(n)$ from the updated memory of the synthesis filter 9. This means an additional saving of 50 multiply-adds per sample.

The encoder operation described so far specifies the way to encode a single input speech vector. The encoding of the entire speech waveform is achieved by repeating the above operation for every speech vector.

*3.11 Synchronization & In-band Signalling*

In the above description of the encoder, it is assumed that the decoder knows the boundaries of the received 10-bit codebook indices and also knows when the synthesis filter and the log-gain predictor need to be updated (recall that they are updated once every 4 vectors). In practice, such synchronization information can be made available to the decoder by adding extra synchronization bits on top of the transmitted 16 kb/s bit stream. However, in many applications there is a need to insert synchronization or in-band signalling bits as part of the 16 kbit/s bit stream. This can be done in the following way. Suppose a synchronization bit is to be inserted once every $N$ speech vectors; then, for every $N$-th input speech vector, we can search through only half of the shape codebook and produce a 6-bit shape codebook index. In this way, we rob one bit out of every $N$-th transmitted codebook index and insert a synchronization or signalling bit instead.

It is important to note that we cannot arbitrarily rob one bit out of an already selected 7-bit shape codebook index, instead, the encoder has to know which speech vectors will be robbed one bit and then search through only half of the codebook for those speech vectors. Otherwise, the decoder will not have the same decoded excitation codevectors for those speech vectors. When the correct practice outlined above is followed, there is on average a 50% chance that the half of the codebook searched contains the optimum shape codevector. In this instance, no degradation results. In the other 50% of the cases, the best shape codevector found will be close to optimal, most likely differing from the optimal vector by only one bit in its codeword index. For this reason, this type of bit robbing results in only small distortion.

Since the coding algorithm has a basic adaptation cycle of 4 vectors, it is reasonable to let $N$ be a multiple of 4 so that the decoder can easily determine the boundaries of the encoder adaptation cycles. For a reasonable value of $N$ (such as 16, which corresponds to a 10 ms bit robbing period), the resulting degradation in speech quality is essentially negligible. In particular, we have found that a value of $N=16$ results in little additional distortion. The rate of this bit robbing is only 100 bits/s.

If the above procedure is followed, we recommend that when the desired bit is to be a 0, only the first half of the shape codebook be searched, i.e. those vectors with indices 0 to 63. When the desired bit is a 1, then the second half of the codebook is searched and the resulting index will be between 64 and 127. The significance of this choice is that the desired bit will be the leftmost bit in the codeword, since the 7 bits for the shape codevector precede the 3 bits for the sign and gain codebook. We further recommend that the synchronization bit be robbed from the last vector in a cycle of 4 vectors. Once it is detected, the next codeword received can begin the new cycle of codevectors.

Although we state that synchronization causes very little distortion, we note that no formal testing has been done on hardware which contained this synchronization strategy. Consequently, the amount of the degradation has not been measured.

However, we specifically recommend against using the synchronization bit for synchronization in systems in which the coder is turned on and off repeatedly. For example, a system might use a speech activity detector to turn off the coder when no speech were present. Each time the encoder was turned on, the decoder would need to locate the synchronization sequence. At 100 bit/s, this would probably take several hundred ms. In addition, time must be allowed for the decoder state to track the encoder state. The combined result would be a phenomena known as front-end clipping in which the beginning of the speech utterance would be lost. If the encoder and decoder are both started at the same instant as the onset of speech, then no speech will be lost. This is only possible in systems using external signalling for the start-up times and external synchronization.

4. LD-CELP DECODER PRINCIPLES

Figure 3 is a block schematic of the LD-CELP decoder. A functional description of each block is given in the following sections.

*4.1 Excitation VQ Codebook*

This block contains an excitation VQ codebook (including shape and gain codebooks) identical to the codebook 19 in the LD-CELP encoder. It uses the received best codebook index to extract the best codevector $y(n)$ selected in the LD-CELP encoder.

*4.2 Gain Scaling Unit*

This block computes the scaled excitation vector $e(n)$ by multiplying each component of $y(n)$ by the gain $\sigma(n)$.

*4.3 Synthesis Filter*

This filter has the same transfer function as the synthesis filter in the LD-CELP encoder (assuming error-free transmission). It filters the scaled excitation vector $e(n)$ to produce the decoded speech vector $s_d(n)$. Note that in order to avoid any possible accumulation of round-off errors during decoding, sometimes it is desirable to exactly duplicate the procedures used in the encoder to obtain $s_q(n)$. If this is the case, and if the encoder obtain $s_q(n)$ from the updated memory of the synthesis filter 9, then the decoder should also compute $s_d(n)$ as the sum of the zero-input response and the zero-state response of the synthesis filter 32, as is done in the encoder.

*4.4 Backward Vector Gain Adapter*

The function of this block is described in Section 3.8.

*4.5 Backward Synthesis Filter Adapter*

The function of this block is described in Section 3.7.

*4.6 Postfilter*

Figure 7:
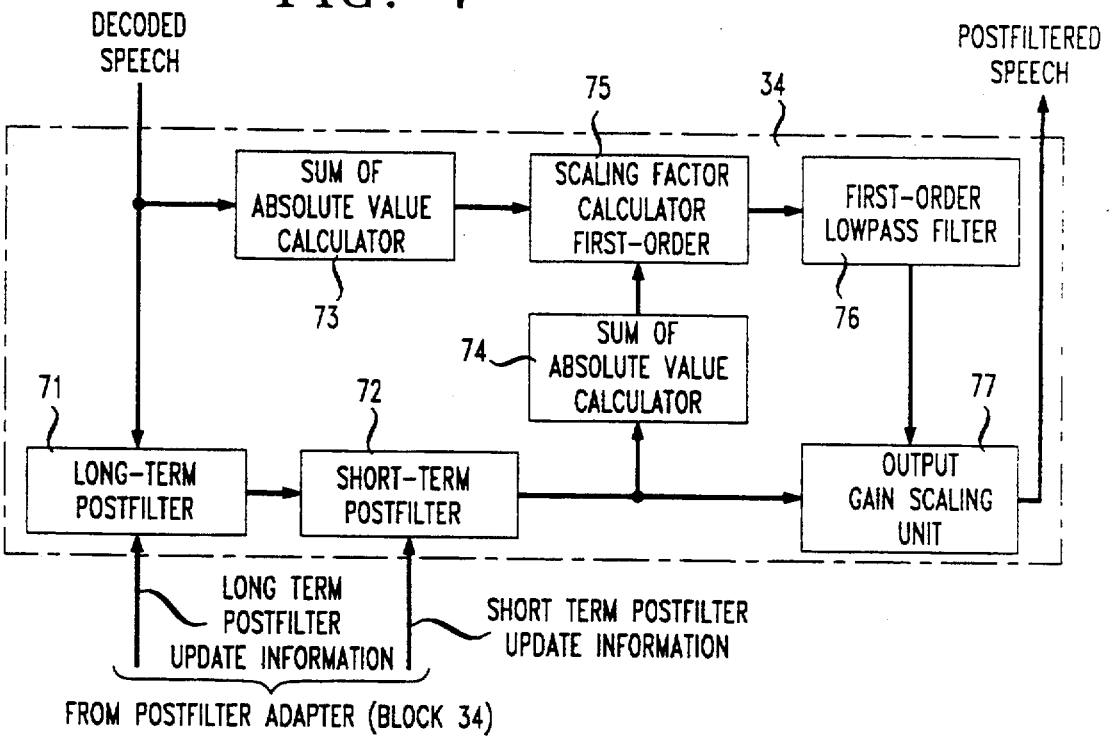
FIG. 7 is a schematic block diagram of a postfilter for use in a Phase 2 System in accordance with an illustrative embodiment of the present invention.

This block filters the decoded speech to enhance the perceptual quality. This block is further expanded in Fig. 7 to show more details. Refer to Fig. 7. The postfilter basically consists of three major parts: (1) long-term postfilter 71, (2) short-term postfilter 72, and (3) output gain scaling unit 77. The other four blocks in Fig. 7 are just to calculate the appropriate scaling factor for use in the output gain scaling unit 77.

The *long-term postfilter* 71, sometimes called the *pitch postfilter*, is a comb filter with its spectral peaks located at multiples of the fundamental frequency (or *pitch frequency*) of the speech to be postfiltered. The reciprocal of the fundamental frequency is called the *pitch period*. The pitch period can be extracted from the decoded speech using a pitch detector (or pitch extractor). Let $p$ be the fundamental pitch period (in samples) obtained by a pitch detector, then the transfer function of the long-term postfilter can be expressed as $$H_l(z) = g_l(1 + b z^{-p}), \tag{24}$$

where the coefficients $g_l$, $b$ and the pitch period $p$ are updated once every 4 speech vectors (an adaptation cycle) and the actual updates occur at the third speech vector of each adaptation cycle. For convenience we will from now on call an adaptation cycle a *frame*. The derivation of $g_l$, $b$, and $p$ will be described later in Sec. 4.7.

The short-term postfilter 72 consists of a 10th-order pole-zero filter in cascade with a first-order all zero filter. The 10th-order pole-zero filter attenuates the frequency components between formant peaks while the first-order all-zero filter attempts to compensate for the spectral tilt in the frequency response of the 10th-order pole-zero filter.

Let $\bar{a}_i$, $i = 1, 2, \ldots, 10$ be the coefficients of the 10th-order LPC predictor obtained by backward LPC analysis of the decoded speech, and let $k_1$ be the first reflection coefficient obtained by the same LPC analysis. Then, both $\bar{a}_i$'s and $k_1$ can be obtained as by-products of the 50th-order backward LPC analysis (block 50 in Fig. 5). All we have to do is to stop the 50th-order Levinson-Durbin recursion at order 10, copy $k_1$ and $\bar{a}_1, \bar{a}_2, \ldots, \bar{a}_{10}$, and then resume the Levinson-Durbin recursion from order 11 to order 50. The transfer function of the short-term postfilter is $$H_s(z) = \frac{1 - \sum_{i=1}^{10} \bar{b}_i z^{-i}}{1 - \sum_{i=1}^{10} \bar{a}_i z^{-i}} [1 + \mu z^{-1}] \tag{25}$$

where $$\bar{b}_i = \bar{a}_i (0.65)^i, \; i = 1, 2, \ldots, 10, \tag{26}$$

$$\bar{a}_i = \bar{a}_i (0.75)^i, \; i = 1, 2, \ldots, 10, \tag{27}$$

and $$\mu = (0.15) k_1 \tag{28}$$

The coefficients $\bar{a}_i$'s, $\bar{b}_i$'s, and $\mu$ are also updated once a frame, but the updates take place at the first vector of each frame (i.e. as soon as $\bar{a}_i$'s become available).

In general, after the decoded speech is passed through the long-term postfilter and the short-term postfilter, the filtered speech will not have the same power level as the decoded (unfiltered) speech. To avoid occasional large gain excursions, it is necessary to use automatic gain control to force the postfiltered speech to have roughly the same power as the unfiltered speech. This is done by blocks 73 through 77.

The sum of absolute value calculator 73 operates vector-by-vector. It takes the current decoded speech vector $s_d(n)$ and calculates the sum of the absolute values of its 5 vector components. Similarly, the sum of absolute value calculator 74 performs the same type of calculation, but on the current output vector $s_f(n)$ of the short-term postfilter. The scaling factor calculator 75 then divides the output value of block 73 by the output value of block 74 to obtain a scaling factor for the current $s_f(n)$ vector. This scaling factor is then filtered by a first-order lowpass filter 76 to get a separate scaling factor for each of the 5 components of $s_f(n)$. The first-order lowpass filter 76 has a transfer function of $0.01/(1-0.99z^{-1})$. The lowpass filtered scaling factor is used by the output gain scaling unit 77 to perform sample-by-sample scaling of the short-term postfilter output. Note that since the scaling factor calculator 75 only generates one scaling factor per vector, it would have a stair-case effect on the sample-by-sample scaling operation of block 77 if the lowpass filter 76 were not present. The lowpass filter 76 effectively smoothes out such a stair-case effect.

*4.6.1 Non-speech Operation* CCITT objective test results indicate that for some non-speech signals, the performance of the coder is improved when the adaptive postfilter is turned off. Since the input to the adaptive postfilter is the output of the synthesis filter, this signal is always available. In our implementation we simply output this unfiltered signal when the switch was set to disable the postfilter.

*4.7 Postfilter Adapter*

This block calculates and updates the coefficients of the postfilter once a frame. This postfilter adapter is further expanded in Fig. 8.

Figure 8:
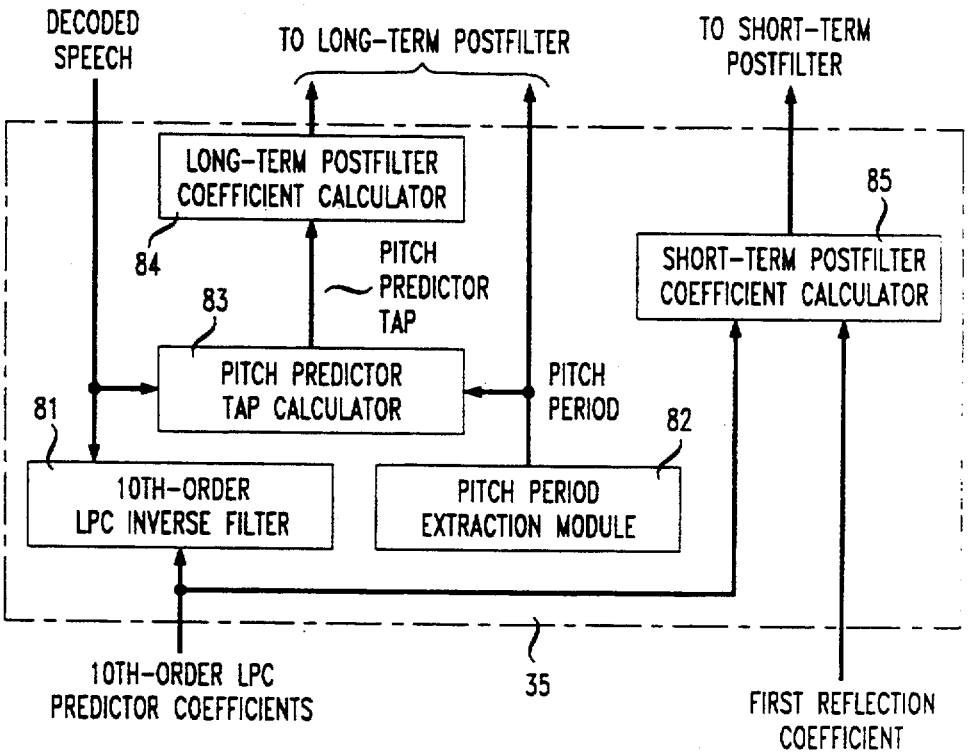
FIG. 8 is a schematic block diagram of a postfilter adapter for use in a Phase 2 System in accordance with an illustrative embodiment of the present invention.

Refer to Fig. 8. The 10th-order LPC inverse filter 81 and the pitch period extraction module 82 work together to extract the pitch period from the decoded speech. In fact, any pitch extractor with reasonable performance (and without introducing additional delay) may be used here. What we described here is only one possible way of implementing a pitch extractor.

The 10th-order LPC inverse filter 81 has a transfer function of $$\bar{A}(z) = 1 - \sum_{i=1}^{10} \bar{a}_i z^{-i}, \tag{29}$$

where the coefficients $\bar{a}_i$'s are supplied by the Levinson-Durbin recursion module (block 50 of Fig. 5) and are updated at the first vector of each frame. This LPC inverse filter takes the decoded speech as its input and produces the LPC prediction residual sequence $\{d(k)\}$ as its output. We use a pitch analysis window size of 100 samples and a range of pitch period from 20 to 140 samples. The pitch period extraction module 82 maintains a long buffer to hold the last 240 samples of the LPC prediction residual. For indexing convenience, the 240 LPC residual samples stored in the buffer are indexed as $d(-139), d(-138), \ldots, d(100)$.

The pitch period extraction module 82 extracts the pitch period once a frame, and the pitch period is extracted at the third vector of each frame. Therefore, the LPC inverse filter output vectors should be stored into the LPC residual buffer in a special order: the LPC residual vector corresponding to the fourth vector of the last frame is stored as $d(81), d(82), \ldots, d(85)$, the LPC residual of the first vector of the current frame is stored as $d(86), d(87), \ldots, d(90)$, the LPC residual of the second vector of the current frame is stored as $d(91), d(92), \ldots, d(95)$, and the LPC residual of the third vector is stored as $d(96), d(97), \ldots, d(100)$. The samples $d(-139), d(-138), \ldots, d(80)$ are simply the previous LPC residual samples arranged in the correct time order.

Once the LPC residual buffer is ready, the pitch period extraction module 82 works in the following way. First, the last 20 samples of the LPC residual buffer ($d(81)$ through $d(100)$) is lowpass filtered at 1 kHz by a third-order elliptic filter (coefficients given in Annex C) and then 4:1 decimated (i.e. down-sampled by a factor of 4). This results in 5 lowpass filtered and decimated LPC residual samples, denoted $\bar{d}(21), \bar{d}(22), \ldots, \bar{d}(25)$, which are stored as the last 5 samples in a decimated LPC residual buffer. Besides these 5 samples, the other 55 samples $\bar{d}(-34), \bar{d}(-33), \ldots, \bar{d}(20)$ in the decimated LPC residual buffer are obtained by shifting previous frames of decimated LPC residual samples. The $i$-th correlation of the decimated LPC residual samples are then computed as $$\rho(i) = \sum_{n=1}^{25} \bar{d}(n)\bar{d}(n-i) \tag{30}$$

for time lags $i = 5, 6, 7, \ldots, 35$ (which correspond to pitch periods from 20 to 140 samples). The time lag $\tau$ which gives the largest of the 31 calculated correlation values is then identified. Since this time lag $\tau$ is the lag in the 4:1 decimated residual domain, the corresponding time lag which gives the maximum correlation in the original undecimated residual domain should lie between $4\tau-3$ and $4\tau+3$. To get the original time resolution, we next use the undecimated LPC residual buffer to compute the correlation of the undecimated LPC residual $$C(i) = \sum_{k=1}^{100} d(k)\,d(k-i) \tag{31}$$

for 7 lags $i = 4\tau-3, 4\tau-2, \ldots, 4\tau+3$. Out of the 7 time lags, the lag $p_0$ that gives the largest correlation is identified.

The time lag $p_0$ found this way may turn out to be a multiple of the true fundamental pitch period. What we need in the long-term postfilter is the true fundamental pitch period, not any multiple of it. Therefore, we need to do more processing to find the fundamental pitch period. We make use of the fact that we estimate the pitch period quite frequently — once every 20 speech samples. Since the pitch period typically varies between 20 and 140 samples, our frequent pitch estimation means that, at the beginning of each talk spurt, we will first get the fundamental pitch period before the multiple pitch periods have a chance to show up in the correlation peak-picking process described above. From there on, we will have a chance to lock on to the fundamental pitch period by checking to see if there is any correlation peak in the neighborhood of the pitch period of the previous frame.

Let $\hat{p}$ be the pitch period of the previous frame. If the time lag $p_0$ obtained above is not in the neighborhood of $\hat{p}$, then we also evaluate Eq. (31) for $i = \hat{p}-6, \hat{p}-5, \ldots, \hat{p}+5, \hat{p}+6$. Out of these 13 possible time lags, the time lag $p_1$ that gives the largest correlation is identified. We then test to see if this new lag $p_1$ should be used as the output pitch period of the current frame. First, we compute $$\beta_0 = \frac{\sum_{k=1}^{100} d(k)\,d(k-p_0)}{\sum_{k=1}^{100} d(k-p_0)\,d(k-p_0)}, \tag{32}$$

which is the optimal tap weight of a single-tap pitch predictor with a lag of $p_0$ samples. The value of $\beta_0$ is then clamped between 0 and 1. Next, we also compute $$\beta_1 = \frac{\sum_{k=1}^{100} d(k)\,d(k-p_1)}{\sum_{k=1}^{100} d(k-p_1)\,d(k-p_1)}, \tag{33}$$

which is the optimal tap weight of a single-tap pitch predictor with a lag of $p_1$ samples. The value of $\beta_1$ is then also clamped between 0 and 1. Then, the output pitch period $p$ of block 82 is given by $$p = \begin{cases} p_0 & \text{if } \beta_1 \le 0.4\beta_0 \\ p_1 & \text{if } \beta_1 > 0.4\beta_0 \end{cases} \tag{34}$$

After the pitch period extraction module 82 extracts the pitch period $p$, the pitch predictor tap calculator 83 then calculates the optimal tap weight of a single-tap pitch predictor for the decoded speech. The pitch predictor tap calculator 83 and the long-term postfilter 71 shares a long buffer of decoded speech samples. This buffer contains decoded speech samples $s_d(-239), s_d(-238), s_d(-237), \ldots, s_d(4), s_d(5)$, where $s_d(1)$ through $s_d(5)$ correspond to the current vector of decoded speech. The long-term postfilter 71 uses this buffer as the delay unit of the filter. On the other hand, the pitch predictor tap calculator 83 uses this buffer to calculate $$\beta = \frac{\sum_{k=-99}^{0} s_d(k)s_d(k-p)}{\sum_{k=-99}^{0} s_d(k-p)s_d(k-p)} \tag{35}$$

The long-term postfilter coefficient calculator 84 then takes the pitch period $p$ and the pitch predictor tap $\beta$ and calculates the long-term postfilter coefficients $b$ and $g_l$ as follows.

$$b = \begin{cases} 0 & \text{if } \beta < 0.6 \\ 0.15\beta & \text{if } 0.6 \le \beta \le 1 \\ 0.15 & \text{if } \beta > 1 \end{cases} \tag{36}$$

$$g_l = \frac{1}{1+b} \tag{37}$$

In general, the closer $\beta$ is to unity, the more periodic the speech waveform is. As can be seen in Eqs. (36) and (37), if $\beta < 0.6$, which roughly corresponds to unvoiced or transition regions of speech, then $b = 0$ and $g_l = 1$, and the long-term postfilter transfer function becomes $H_l(z) = 1$, which means the filtering operation of the long-term postfilter is totally disabled. On the other hand, if $0.6 \le \beta \le 1$, the long-term postfilter is turned on, and the degree of comb filtering is determined by $\beta$. The more periodic the speech waveform, the more comb filtering is performed. Finally, if $\beta > 1$, then $b$ is limited to 0.15; this is to avoid too much comb filtering. The coefficient $g_l$ is a scaling factor of the long-term postfilter to ensure that the voiced regions of speech waveforms do not get amplified relative to the unvoiced or transition regions. (If $g_l$ were held constant at unity, then after the long-term postfiltering, the voiced regions would be amplified by a factor of $1+b$ roughly. This would make some consonants, which correspond to unvoiced and transition regions, sound unclear or too soft.)

The short-term postfilter coefficient calculator 85 calculates the short-term postfilter coefficients $\bar{a}_i$'s, $\bar{b}_i$'s, and $\mu$ at the first vector of each frame according to Eqs. (26), (27), and (28).

4.8 Output PCM Format Conversion

This block converts the 5 components of the decoded speech vector $s_d(n)$ into 5 corresponding $A$-law or $\mu$-law PCM samples and put out these 5 PCM samples sequentially at 125 $\mu$s time intervals. Note that if the internal linear PCM format has been scaled as described in section 3.1.1, the inverse scaling must be performed before conversion to $A$-law or $\mu$-law PCM.

5. COMPUTATIONAL DETAILS

This section provides the computational details for each of the LD-CELP encoder and decoder elements. Sections 5.1 and 5.2 list the names of coder parameters and internal processing variables which will be referred to in later sections. The detailed specification of each block in Fig. 2 through Fig. 6 is given in Section 5.3 through the end of Section 5. To encode and decode an input speech vector, the various blocks of the encoder and the decoder are executed in an order roughly follows the sequence from Section 5.3 to the end.

5.1 Description of Basic Coder Parameters

The names of basic coder parameters are defined in Table 1. In Table 1, the first column gives the names of coder parameters which will be used in later detailed description of the LD-CELP algorithm. If a parameter has been referred to in Section 3 or 4 but was represented by a different symbol, that equivalent symbol will be given in the second column for easy reference. Each coder parameter has a fixed value which is determined in the coder design stage. The third column shows these fixed parameter values, and the fourth column is a brief description of the coder parameters.

| Name | Equivalent Symbol | Value | Description |
|---|---|---|---|
| AGCFAC | | 0.99 | AGC adaptation speed controlling factor |
| FAC | $\lambda$ | 253/256 | Bandwidth expansion factor of synthesis filter |
| FACGP | $\lambda_g$ | 29/32 | Bandwidth expansion factor of log-gain predictor |
| DIMINV | | 0.2 | Reciprocal of vector dimension |
| IDIM | | 5 | Vector dimension (excitation block size) |
| GOFF | | 32 | Log-gain offset value |
| KPDELTA | | 6 | Allowed deviation from previous pitch period |
| KPMIN | | 20 | Minimum pitch period (samples) |
| KPMAX | | 140 | Maximum pitch period (samples) |
| LPC | | 50 | Synthesis filter order |
| LPCLG | | 10 | Log-gain predictor order |
| LPCW | | 10 | Perceptual weighting filter order |
| NCWD | | 128 | Shape codebook size (no. of codevectors) |
| NFRSZ | | 20 | Frame size (adaptation cycle size in samples) |
| NG | | 8 | Gain codebook size (no. of gain levels) |
| NONR | | 35 | No. of non-recursive window samples for synthesis filter |
| NONRLG | | 20 | No. of non-recursive window samples for log-gain predictor |
| NONRW | | 30 | No. of non-recursive window samples for weighting filter |
| NPWSZ | | 100 | Pitch analysis window size (samples) |
| NUPDATE | | 4 | Predictor update period (in terms of vectors) |
| PPFTH | | 0.6 | Tap threshold for turning off pitch postfilter |
| PPFZCF | | 0.15 | Pitch postfilter zero controlling factor |
| SPFPCF | | 0.75 | Short-term postfilter pole controlling factor |
| SPFZCF | | 0.65 | Short-term postfilter zero controlling factor |
| TAPTH | | 0.4 | Tap threshold for fundamental pitch replacement |
| TILTF | | 0.15 | Spectral tilt compensation controlling factor |
| WNCF | | 257/256 | White noise correction factor |
| WPCF | $\gamma_2$ | 0.6 | Pole controlling factor of perceptual weighting filter |
| WZCF | $\gamma_1$ | 0.9 | Zero controlling factor of perceptual weighting filter |

Table 1 Basic Coder Parameters of LD-CELP

*5.2 Description of Internal Variables*

The internal processing variables of LD-CELP are listed in Table 2, which has a layout similar to Table 1. The second column shows the range of index in each variable array. The fourth column gives the recommended initial values of the variables. The initial values of some arrays are given in Annexes A, B or C. It is recommended (although not required) that the internal variables be set to their initial values when the encoder or decoder just starts running, or whenever a reset of coder states is needed (such as in DCME applications). These initial values ensure that there will be no glitches right after start-up or resets.

Note that some variable arrays can share the same physical memory locations to save memory space, although they are given different names in the tables to enhance clarity.

As mentioned in earlier sections, the processing sequence has a basic adaptation cycle of 4 speech vectors. The variable ICOUNT is used as the vector index. In other words, ICOUNT = $n$ when the encoder or decoder is processing the $n$-th speech vector in an adaptation cycle.

In the following sections, the asterisk * denotes arithmetic multiplication.

| Name | Array Index Range | Equivalent Symbol | Initial Value | Description |
|---|---|---|---|---|
| A | 1 to LPC+1 | $-a_{i-1}$ | 1,0,0,... | Synthesis filter coefficients |
| AL | 1 to 3 | | Annex C | 1 kHz lowpass filter denominator coeff. |
| AP | 1 to 11 | $-\bar{a}_{i-1}$ | 1,0,0,... | Short-term postfilter denominator coeff. |
| APF | 1 to 11 | $-\tilde{a}_{i-1}$ | 1,0,0,... | 10th-order LPC filter coefficients |
| ATMP | 1 to LPC+1 | $-a_{i-1}$ | | Temporary buffer for synthesis filter coeff. |
| AWP | 1 to LPCW+1 | | 1,0,0,... | Perceptual weighting filter denominator coeff. |
| AWZ | 1 to LPCW+1 | | 1,0,0,... | Perceptual weighting filter numerator coeff. |
| AWZTMP | 1 to LPCW+1 | | 1,0,0,... | Temporary buffer for weighting filter coeff. |
| AZ | 1 to 11 | $-\bar{b}_{i-1}$ | 1,0,0,... | Short-term postfilter numerator coeff. |
| B | 1 | $b$ | 0 | Long-term postfilter coefficient |
| BL | 1 to 4 | | Annex C | 1 kHz lowpass filter numerator coeff. |
| DEC | -34 to 25 | $\bar{d}(n)$ | 0,0,...,0 | 4:1 decimated LPC prediction residual |
| D | -139 to 100 | $d(k)$ | 0,0,...,0 | LPC prediction residual |
| ET | 1 to IDIM | $e(n)$ | 0,0,...,0 | Gain-scaled excitation vector |
| FACV | 1 to LPC+1 | $\lambda^{i-1}$ | Annex C | Synthesis filter BW broadening vector |
| FACGPV | 1 to LPCLG+1 | $\lambda_g^{i-1}$ | Annex C | Gain predictor BW broadening vector |
| G2 | 1 to NG | $b_i$ | Annex C | 2 times gain levels in gain codebook |
| GAIN | 1 | $\sigma(n)$ | | Excitation gain |
| GB | 1 to NG-1 | $d_i$ | Annex C | Mid-point between adjacent gain levels |
| GL | 1 | $g_l$ | 1 | Long-term postfilter scaling factor |
| GP | 1 to LPCLG+1 | $-\alpha_{i-1}$ | 1,-1,0,0,... | log-gain linear predictor coeff. |
| GPTMP | 1 to LPCLG+1 | $-\alpha_{i-1}$ | | temp. array for log-gain linear predictor coeff. |
| GQ | 1 to NG | $g_i$ | Annex C | Gain levels in the gain codebook |
| GSQ | 1 to NG | $c_i$ | Annex C | Squares of gain levels in gain codebook |
| GSTATE | 1 to LPCLG | $\delta(n)$ | -32,-32,...,-32 | Memory of the log-gain linear predictor |
| H | 1 to IDIM | $h(n)$ | 1,0,0,0,0 | Impulse response vector of $F(z)W(z)$ |
| ICHAN | 1 | | | Best codebook index to be transmitted |
| ICOUNT | 1 | | | Speech vector counter (indexed from 1 to 4) |
| IG | 1 | $i$ | | Best 3-bit gain codebook index |
| IP | 1 | | IPINIT** | Address pointer to LPC prediction residual |
| IS | 1 | $j$ | | Best 7-bit shape codebook index |
| KP | 1 | $p$ | | Pitch period of the current frame |
| KP1 | 1 | $\hat{p}$ | 50 | Pitch period of the previous frame |
| PN | 1 to IDIM | $p(n)$ | | Correlation vector for codebook search |
| PTAP | 1 | $\beta$ | | Pitch predictor tap computed by block 83 |
| R | 1 to NR+1* | | | Autocorrelation coefficients |
| RC | 1 to NR* | | | Reflection coeff., also as a scratch array |
| RCTMP | 1 to LPC | | | Temporary buffer for reflection coeff. |
| REXP | 1 to LPC+1 | | 0,0,...,0 | Recursive part of autocorrelation, syn. filter |
| REXPLG | 1 to LPCLG+1 | | 0,0,...,0 | Recursive part of autocorrelation, log-gain pred. |
| REXPW | 1 to LPCW+1 | | 0,0,...,0 | Recursive part of autocorrelation, weighting filter |

* NR = Max(LPCW,LPCLG) > IDIM
** IPINIT = NPWSZ-NFRSZ+IDIM

Table 2 LD-CELP Internal Processing Variables

| Name | Array Index Range | Equivalent Symbol | Initial Value | Description |
|---|---|---|---|---|
| RTMP | 1 to LPC+1 | | | Temporary buffer for autocorrelation coeff. |
| S | 1 to IDIM | $s(n)$ | 0.0....0 | Uniform PCM input speech vector |
| SB | 1 to 105 | | 0.0....0 | Buffer for previously quantized speech |
| SBLG | 1 to 34 | | 0.0....0 | Buffer for previous log-gain |
| SBW | 1 to 60 | | 0.0....0 | Buffer for previous input speech |
| SCALE | 1 | | | Unfiltered postfilter scaling factor |
| SCALEFIL | 1 | | 1 | Lowpass filtered postfilter scaling factor |
| SD | -239 to IDIM | $s_d(k)$ | | Decoded speech buffer |
| SPF | 1 to IDIM | | | Postfiltered speech vector |
| SPFPCFV | 1 to 11 | $SPFPCF^{i-1}$ | Annex C | Short-term postfilter pole controlling vector |
| SPFZCFV | 1 to 11 | $SPVZCF^{i-1}$ | Annex C | Short-term postfilter zero controlling vector |
| SO | 1 | $s_o(k)$ | | A-law or μ-law PCM input speech sample |
| SU | 1 | $s_u(k)$ | | Uniform PCM input speech sample |
| ST | 1 to IDIM | $s_q(n)$ | 0.0....0 | Quantized speech vector |
| STATELPC | 1 to LPC | | 0.0....0 | Synthesis filter memory |
| STLPCI | 1 to 10 | | 0.0....0 | LPC inverse filter memory |
| STLPF | 1 to 3 | | 0.0.0 | 1 kHz lowpass filter memory |
| STMP | 1 to 4*IDIM | | 0.0....0 | Buffer for per. wt. filter hybrid window |
| STPFFIR | 1 to 10 | | 0.0....0 | Short-term postfilter memory, all-zero section |
| STPFIIR | 10 | | 0.0....0 | Short-term postfilter memory, all-pole section |
| SUMFIL | 1 | | | Sum of absolute value of postfiltered speech |
| SUMUNFIL | 1 | | | Sum of absolute value of decoded speech |
| SW | 1 to IDIM | $v(n)$ | | Perceptually weighted speech vector |
| TARGET | 1 to IDIM | $\tilde{x}(n)$ $x(n)$ | | (gain-normalized) VQ target vector |
| TEMP | 1 to IDIM | | | scratch array for temporary working space |
| TILTZ | 1 | $\mu$ | 0 | Short-term postfilter tilt-compensation coeff. |
| WFIR | 1 to LPCW | | 0.0....0 | Memory of weighting filter 4, all-zero portion |
| WIIR | 1 to LPCW | | 0.0....0 | Memory of weighting filter 4, all-pole portion |
| WNR | 1 to 105 | $w_m(k)$ | Annex A | Window function for synthesis filter |
| WNRLG | 1 to 34 | $w_m(k)$ | Annex A | Window function for log-gain predictor |
| WNRW | 1 to 60 | $w_m(k)$ | Annex A | Window function for weighting filter |
| WPCFV | 1 to LPCW+1 | $\gamma_2^{i-1}$ | Annex C | Perceptual weighting filter pole controlling vector |
| WS | 1 to 105 | | | Work Space array for intermediate variables |
| WZCFV | 1 to LPCW+1 | $\gamma_1^{i-1}$ | Annex C | Perceptual weighting filter zero controlling vector |
| Y | 1 to IDIM*NCWD | $y_j$ | Annex B | Shape codebook array |
| Y2 | 1 to NCWD | $E_j$ | Energy of $y_j$ | Energy of convolved shape codevector |
| YN | 1 to IDIM | $y(n)$ | | Quantized excitation vector |
| ZIRWFIR | 1 to LPCW | | 0.0....0 | Memory of weighting filter 10, all-zero portion |
| ZIRWIIR | 1 to LPCW | | 0.0....0 | Memory of weighting filter 10, all-pole portion |

Table 2 LD-CELP Internal Processing Variables (Continued)

It should be noted that, for the convenience of Levinson-Durbin recursion, the first element of A ATMP, AWP, AWZ, and GP arrays are always 1 and never get changed, and, for $i \geq 2$, the $i$-th elements are the $(i-1)$-th elements of the corresponding symbols in Section 3.

---

*5.3 Input PCM Format Conversion (block 1)*

Input: SO

Output: SU

Function: Convert A-law or μ-law or 16-bit linear input sample to uniform PCM sample.

Since the operation of this block is completely defined in G.721 or G.711, we will not repeat it here. However, recall from section 3.1.1 that some scaling may be necessary to conform to this description's specification of an input range of -4095 to +4095.

---

*5.4 Vector Buffer (block 2)*

Input: SU

Output: S

Function: Buffer 5 consecutive uniform PCM speech samples to form a single 5-dimensional speech vector.

---

*5.5 Adapter for Perceptual Weighting Filter (block 3, Fig. 4 (a))*

The three blocks (36, 37 and 38) in Fig. 4 (a) are now specified in detail below.

HYBRID WINDOWING MODULE (block 36)

Input: STMP

Output: R

Function: Apply the hybrid window to input speech and compute autocorrelation coefficients.

The operation of this module is now described below, using a "Fortran-like" style, with loop boundaries indicated by indentation and comments on the right-hand side of "|". The following algorithm is to be used once every adaptation cycle (20 samples). The STMP array hold 4 consecutive input speech vectors up to the second speech vector of the current adaptation cycle. That is, STMP(1) through STMP(5) is the third input speech vector of the previous adaptation cycle (zero initially), STMP(6) through STMP(10) is the fourth input speech vector of the previous adaptation cycle (zero initially). STMP(11) through STMP(15) is the first input speech vector of the current adaptation cycle, and STMP(16) through STMP(20) is the second input speech vector of the current adaptation cycle.

```
N1=LPCW+NFRSZ                        | compute some constants (can be
N2=LPCW+NONRW                        | precomputed and stored in memory)
N3=LPCW+NFRSZ+NONRW

For N=1,2,...,N2, do the next line
    SBW(N)=SBW(N+NFRSZ)              | shift the old signal buffer;
For N=1,2,...,NFRSZ, do the next line
    SBW(N2+N)=STMP(N)                | shift in the new signal;
                                     | SBW(N3) is the newest sample
K=1
For N=N3,N3-1,...,3,2,1, do the next 2 lines
    WS(N)=SBW(N)*WNRW(K)             | multiply the window function
    K=K+1

For I=1,2,...,LPCW+1, do the next 4 lines
    TMP=0.
    For N=LPCW+1,LPCW+2,...,N1, do the next line
        TMP=TMP+WS(N)*WS(N+1-I)
    REXPW(I)=(1/2)*REXPW(I)+TMP      | update the recursive component

For I=1,2,...,LPCW+1, do the next 3 lines
    R(I)=REXPW(I)
    For N=N1+1,N1+2,...,N3, do the next line
        R(I)=R(I)+WS(N)*WS(N+1-I)    | add the non-recursive component

R(1)=R(1)*WNCF                       | white noise correction
```

---

LEVINSON-DURBIN RECURSION MODULE (block 37)

Input: R (output of block 36)

Output: AWZTMP

Function: Convert autocorrelation coefficients to linear predictor coefficients.

This block is executed once every 4-vector adaptation cycle. It is done at ICOUNT=3 after the processing of block 36 has finished. Since the Levinson-Durbin recursion is well-known prior art, the algorithm is given below without explanation.

```
If R(LPCW+1) = 0, go to LABEL                | Skip if zero
                                             |
If R(1) ≤ 0, go to LABEL                     | Skip if zero signal.
                                             |
RC(1)=-R(2)/R(1)
AWZTMP(1)=1.                                 |
AWZTMP(2)=RC(1)                              | First-order predictor
ALPHA=R(1)+R(2)*RC(1)                        |
If ALPHA ≤ 0, go to LABEL                    | Abort if ill-conditioned

For MINC=2,3,4,...,LPCW, do the following
    SUM=0.
    For IP=1,2,3,...,MINC, do the next 2 lines
        N1=MINC-IP+2
        SUM=SUM+R(N1)*AWZTMP(IP)
                                             |
    RC(MINC)=-SUM/ALPHA                      | Reflection coeff.
    MH=MINC/2+1                              |
    For IP=2,3,4,....,MH, do the next 4 lines
        IB=MINC-IP+2
        AT=AWZTMP(IP)+RC(MINC)*AWZTMP(IB)            |
        AWZTMP(IB)=AWZTMP(IB)+RC(MINC)*AWZTMP(IP)    | Predictor coeff.
        AWZTMP(IP)=AT                                |

    AWZTMP(MINC+1)=RC(MINC)                  |
    ALPHA=ALPHA+RC(MINC)*SUM                 | Prediction residual energy.
    If ALPHA ≤ 0, go to LABEL                | Abort if ill-conditioned.
                                             |
Repeat the above for the next MINC
                                             | Program terminates normally
Exit this program                            | if execution proceeds to
                                             | here.
LABEL:  If program proceeds to here, ill-conditioning had happened,
      then, skip block 38, do not update the weighting filter coefficients
      (That is, use the weighting filter coefficients of the previous
      adaptation cycle.)
```

---

WEIGHTING FILTER COEFFICIENT CALCULATOR (block 38)

Input: AWZTMP

Output: AWZ, AWP

Function: Calculate the perceptual weighting filter coefficients from the linear predictor coefficients for input speech.

This block is executed once every adaptation cycle. It is done at ICOUNT=3 after the processing of block 37 has finished.

```
For I=2,3,...,LPCW+1, do the next line          |
    AWP(I)=WPCFV(I)*AWZTMP(I)                   | Denominator coeff.

For I=2,3,...,LPCW+1, do the next line          |
    AWZ(I)=WZCFV(I)*AWZTMP(I)                   | Numerator coeff.
```

*5.6 Backward Synthesis Filter Adapter (block 23, Fig. 5)*

The three blocks (49, 50, and 51) in Fig. 5 are specified below.

HYBRID WINDOWING MODULE (block 49)

Input: STTMP

Output: RTMP

Function: Apply the hybrid window to quantized speech and compute autocorrelation coefficients.

The operation of this block is essentially the same as in block 36, except for some substitutions of parameters and variables, and for the sampling instant when the autocorrelation coefficients are obtained. As described in Section 3, the autocorrelation coefficients are computed based on the quantized speech vectors up to the last vector in the previous 4-vector adaptation cycle. In other words, the autocorrelation coefficients used in the current adaptation cycle is based on the information contained in the quantized speech up to the last (20-th) sample of the previous adaptation cycle. (This is in fact how we define the adaptation cycle.) The STTMP array contains the 4 quantized speech vectors of the previous adaptation cycle.

```
N1=LPC+NFRSZ                        | compute some constants (can be
N2=LPC+NONR                         | precomputed and stored in memory)
N3=LPC+NFRSZ+NONR

For N=1,2,...,N2, do the next line
    SB(N)=SB(N+NFRSZ)               | shift the old signal buffer;
For N=1,2,...,NFRSZ, do the next line
    SB(N2+N)=STTMP(N)               | shift in the new signal;
                                    | SB(N3) is the newest sample
K=1
For N=N3,N3-1,...,3,2,1, do the next 2 lines
    WS(N)=SB(N)*WNR(K)              | multiply the window function
    K=K+1

For I=1,2,...,LPC+1, do the next 4 lines
    TMP=0.
    For N=LPC+1,LPC+2,...,N1, do the next line
        TMP=TMP+WS(N)*WS(N+1-I)
    REXP(I)=(3/4)*REXP(I)+TMP       | update the recursive component

For I=1,2,...,LPC+1, do the next 3 lines
    RTMP(I)=REXP(I)
    For N=N1+1,N1+2,...,N3, do the next line
        RTMP(I)=RTMP(I)+WS(N)*WS(N+1-I)
                                    | add the non-recursive component

RTMP(1)=RTMP(1)*WNCF                | white noise correction
```

LEVINSON-DURBIN RECURSION MODULE (block 50)

Input: RTMP

Output: ATMP

Function: Convert autocorrelation coefficients to synthesis filter coefficients.

The operation of this block is exactly the same as in block 37, except for some substitutions of parameters and variables. However, special care should be taken when implementing this block. As described in Section 3, although the autocorrelation RTMP array is available at the first vector of each adaptation cycle, the actual updates of synthesis filter coefficients will not take place until the third vector. This intentional delay of updates allows the real-time hardware to spread the computation of this module over the first three vector of each adaptation cycle. While this module is being executed during the first two vectors of each cycle, the old set of synthesis filter coefficients (the array "A") obtained in the previous cycle is still being used. This is why we need to keep a separate array ATMP to avoid overwriting the old "A" array. Similarly, RTMP, RCTMP, ALPHATMP, etc. are used to avoid interference to other Levinson-Durbin recursion modules (blocks 37 and 44).

```
If RTMP(LPC+1) = 0, go to LABEL                | Skip if zero
                                               |
If RTMP(1) ≤ 0, go to LABEL                    | Skip if zero signal.
                                               |
RCTMP(1)=-RTMP(2)/RTMP(1)
ATMP(1)=1.                                     |
ATMP(2)=RCTMP(1)                               | First-order predictor
ALPHATMP=RTMP(1)+RTMP(2)*RCTMP(1)              |
if ALPHATMP ≤ 0, go to LABEL                   | Abort if ill-conditioned

For MINC=2,3,4,...,LPC, do the following
    SUM=0.
    For IP=1,2,3,...,MINC, do the next 2 lines
        N1=MINC-IP+2
        SUM=SUM+RTMP(N1)*ATMP(IP)
                                                |
    RCTMP(MINC)=-SUM/ALPHATMP                   | Reflection coeff.
    MH=MINC/2+1                                 |
    For IP=2,3,4,...,MH, do the next 4 lines
        IB=MINC-IP+2
        AT=ATMP(IP)+RCTMP(MINC)*ATMP(IB)        |
        ATMP(IB)=ATMP(IB)+RCTMP(MINC)*ATMP(IP)  | Update predictor coeff.
        ATMP(IP)=AT                             |

    ATMP(MINC+1)=RCTMP(MINC)                |
    ALPHATMP=ALPHATMP+RCTMP(MINC)*SUM       | Pred. residual energy.
    If ALPHATMP ≤ 0, go to LABEL            | Abort if ill-conditioned.
                                            |
Repeat the above for the next MINC
                                            | Recursion completed normally
Exit this program                           | if execution proceeds to
                                            | here.
LABEL:  If program proceeds to here, ill-conditioning had happened,
      then, skip block 51, do not update the synthesis filter coefficients
      (That is, use the synthesis filter coefficients of the previous
      adaptation cycle.)
```

BANDWIDTH EXPANSION MODULE (block 51)

Input: ATMP

Output: A

Function: Scale synthesis filter coefficients to expand the bandwidths of spectral peaks.

This block is executed only once every adaptation cycle. It is done after the processing of block 50 has finished and before the execution of blocks 9 and 10 at ICOUNT=3 take place. When the execution of this module is finished and ICOUNT=3, then we copy the ATMP array to the "A" array to update the filter coefficients.

```
For I=2,3,...,LPC+1, do the next line      |
    ATMP(I)=FACV(I)*ATMP(I)                | scale coeff.

Wait until ICOUNT=3, then                  |
for I=2,3,...,LPC+1, do the next line      | Update coeff. at the third
    A(I)=ATMP(I)                           | vector of each cycle.
```

---

*5.7 Backward Vector Gain Adapter (block 20, Fig. 6)*

The blocks in Fig. 6 are specified below. For implementation efficiency, some blocks are described together as a single block (they are shown separately in Fig. 6 just to explain the concept). All blocks in Fig. 6 are executed once every speech vector, except for blocks 43, 44 and 45, which are executed only when ICOUNT=2.

1-VECTOR DELAY, RMS CALCULATOR, AND LOGARITHM CALCULATOR (blocks 67, 39, and 40)

Input: ET

Output: ETRMS

Function: Calculate the dB level of the Root-Mean Square (RMS) value of the previous gain-scaled excitation vector.

When these three blocks are executed (which is before the VQ codebook search), the ET array contains the gain-scaled excitation vector determined for the previous speech vector. Therefore, the 1-vector delay unit (block 67) is automatically executed. (It appears in Fig. 6 just to enhance clarity.) Since the logarithm calculator immediately follow the RMS calculator, the square root operation in the RMS calculator can be implemented as a "divide-by-two" operation to the output of the logarithm calculator. Hence, the output of the logarithm calculator (the dB value) is $10 * \log_{10}$ ( energy of ET / IDIM ). To avoid overflow of logarithm value when ET = 0 (after system initialization or reset), the argument of the logarithm operation is clipped to 1 if it is too small. Also, we note that ETRMS is usually kept in an accumulator, as it is a temporary value which is immediately processed in block 42.

```
ETRMS = ET(1)*ET(1)                        |
For K=2,3,...,IDIM, do the next line       | Compute energy of ET.
    ETRMS = ETRMS + ET(K)*ET(K)            |

ETRMS = ETRMS*DIMINV                       | Divide by IDIM.
If ETRMS < 1., set ETRMS = 1.              | Clip to avoid log overflow.
ETRMS = 10 * log10 (ETRMS)                 | Compute dB value.
```

---

LOG-GAIN OFFSET SUBTRACTOR (block 42)

Input: ETRMS, GOFF

Output: GSTATE(1)

Function: Subtract the log-gain offset valued held in block 41 from the output of block 40 (dB gain level).

```
GSTATE(1) = ETRMS - GOFF
```

---

HYBRID WINDOWING MODULE (block 43)

Input: GTMP

Output: R

Function: Apply the hybrid window to offset-subtracted log-gain sequence and compute autocorrelation coefficients.

The operation of this block is very similar to block 36, except for some substitutions of parameters and variables, and for the sampling instant when the autocorrelation coefficients are obtained.

An important difference between block 36 and this block is that only 4 (rather than 20) gain sample is fed to this block each time the block is executed.

The log-gain predictor coefficients are updated at the second vector of each adaptation cycle. The GTMP array below contains 4 offset-removed log-gain values, starting from the log-gain of the second vector of the previous adaptation cycle to the log-gain of the first vector of the current adaptation cycle, which is GTMP(1). GTMP(4) is the offset-removed log-gain value from the first vector of the current adaptation cycle, the newest value.

```
N1=LPCLG+NUPDATE                    | compute some constants (can be
N2=LPCLG+NONRLG                     | precomputed and stored in memory)
N3=LPCLG+NUPDATE+NONRLG

For N=1,2,...,N2, do the next line
    SBLG(N)=SBLG(N+NUPDATE)         | shift the old signal buffer;
For N=1,2,...,NUPDATE, do the next line
    SBLG(N2+N)=GTMP(N)              | shift in the new signal;
                                    | SBLG(N3) is the newest sample
K=1
For N=N3,N3-1,...,3,2,1, do the next 2 lines
    WS(N)=SBLG(N)*WNRLG(K)          | multiply the window function
    K=K+1

For I=1,2,...,LPCLG+1, do the next 4 lines
    TMP=0.
    For N=LPCLG+1,LPCLG+2,...,N1, do the next line
        TMP=TMP+WS(N)*WS(N+1-I)
    REXPLG(I)=(3/4)*REXPLG(I)+TMP | update the recursive component

For I=1,2,...,LPCLG+1, do the next 3 lines
    R(I)=REXPLG(I)
    For N=N1+1,N1+2,...,N3, do the next line
        R(I)=R(I)+WS(N)*WS(N+1-I) | add the non-recursive component

R(1)=R(1)*WNCF                      | white noise correction
```

---

LEVINSON-DURBIN RECURSION MODULE (block 44)

Input: R (output of block 43)

Output: GPTMP

Function: Convert autocorrelation coefficients to log-gain predictor coefficients.

The operation of this block is exactly the same as in block 37, except for the substitutions of parameters and variables indicated below: replace LPCW by LPCLG and AWZ by GP. This block is executed only when ICOUNT=2, after block 43 is executed. Note that as the first step, the value of R(LPCLG+1) will be checked. If it is zero, we skip blocks 44 and 45 without updating the log-gain predictor coefficients. (That is, we keep using the old log-gain predictor coefficients determined in the previous adaptation cycle.) This special procedure is designed to avoid a very small glitch that would have otherwise happened right after system initialization or reset. In case the matrix is ill-conditioned, we also skip block 45 and use the old values.

BANDWIDTH EXPANSION MODULE (block 45)

Input: GPTMP

Output: GP

Function: Scale log-gain predictor coefficients to expand the bandwidths of spectral peaks.

This block is executed only when ICOUNT=2, after block 44 is executed.

```
For I=2,3,...,LPCLG+1, do the next line        |
    GP(I)=FACGPV(I)*GPTMP(I)                   | scale coeff.
```

---

LOG-GAIN LINEAR PREDICTOR (block 46)

Input: GP, GSTATE

Output: GAIN

Function: Predict the current value of the offset-subtracted log-gain.

```
GAIN = 0.
For I=LGLPC,LPCLG-1,...,3,2, do the next 2 lines
    GAIN = GAIN - GP(I+1)*GSTATE(I)
    GSTATE(I) = GSTATE(I-1)

GAIN = GAIN - GP(2)*GSTATE(1)
```

---

LOG-GAIN OFFSET ADDER (between blocks 46 and 47)

Input: GAIN, GOFF

Output: GAIN

Function: Add the log-gain offset value back to the log-gain predictor output.

```
GAIN = GAIN + GOFF
```

---

LOG-GAIN LIMITER (block 47)

Input: GAIN

Output: GAIN

Function: Limit the range of the predicted logarithmic gain.

```
If GAIN < 0., set GAIN = 0.      | Correspond to linear gain 1.
If GAIN > 60., set GAIN = 60.    | Correspond to linear gain 100.
```

---

INVERSE LOGARITHM CALCULATOR (block 48)

Input: GAIN

Output: GAIN

Function: Convert the predicted logarithmic gain (in dB) back to linear domain.

$$GAIN = 10^{(GAIN/20)}.$$

---

*5.8 Perceptual Weighting Filter*

PERCEPTUAL WEIGHTING FILTER (block 4)

Input: S, AWZ, AWP

Output: SW

Function: Filter the input speech vector to achieve perceptual weighting.

```
For K=1,2,...,IDIM, do the following
    SW(K) = S(K)
    For J=LPCW,LPCW-1,...,3,2, do the next 2 lines
        SW(K) = SW(K) + WFIR(J)*AWZ(J+1)              | All-zero part
        WFIR(J) = WFIR(J-1)                           | of the filter.

    SW(K) = SW(K) + WFIR(1)*AWZ(2)                    | Handle last one
    WFIR(1) = S(K)                                    | differently.

    For J=LPCW,LPCW-1,...,3,2, do the next 2 lines
        SW(K)=SW(K)-WIIR(J)*AWP(J+1)                  | All-pole part
        WIIR(J)=WIIR(J-1)                             | of the filter.

    SW(K)=SW(K)-WIIR(1)*AWP(2)                        | Handle last one
    WIIR(1)=SW(K)                                     | differently.

Repeat the above for the next K
```

---

*5.9 Computation of Zero-Input Response Vector*

Section 3.5 explains how a "zero-input response vector" $r(n)$ is computed by blocks 9 and 10. Now the operation of these two blocks during this phase is specified below. Their operation during the "memory update phase" will be described later.

SYNTHESIS FILTER (block 9) DURING ZERO-INPUT RESPONSE COMPUTATION

Input: A, STATELPC

Output: TEMP

Function: Compute the zero-input response vector of the synthesis filter.

```
For K=1,2,...,IDIM, do the following
    TEMP(K)=0.
    For J=LPC,LPC-1,...,3,2, do the next 2 lines
        TEMP(K)=TEMP(K)-STATELPC(J)*A(J+1)        | Multiply-add.
        STATELPC(J)=STATELPC(J-1)                 | Memory shift.

    TEMP(K)=TEMP(K)-STATELPC(1)*A(2)              | Handle last one
    STATELPC(1)=TEMP(K)                           | differently.

Repeat the above for the next K
```

---

PERCEPTUAL WEIGHTING FILTER (block 10) DURING ZERO-INPUT RESPONSE COMPUTATION

Input: AWZ, AWP, ZIRWFIR, ZIRWIIR, TEMP computed above

Output: ZIR

Function: Compute the zero-input response vector of the perceptual weighting filter.

```
For K=1,2,...,IDIM, do the following
  TMP = TEMP(K)
    For J=LPCW,LPCW-1,...,3,2, do the next 2 lines
        TEMP(K) = TEMP(K) + ZIRWFIR(J)*AWZ(J+1)       | All-zero part
        ZIRWFIR(J) = ZIRWFIR(J-1)                     | of the filter.

    TEMP(K) = TEMP(K) + ZIRWFIR(1)*AWZ(2)             | Handle last one
    ZIRWFIR(1) = TMP

    For J=LPCW,LPCW-1,...,3,2, do the next 2 lines
        TEMP(K)=TEMP(K)-ZIRWIIR(J)*AWP(J+1)           | All-pole part
        ZIRWIIR(J)=ZIRWIIR(J-1)                       | of the filter.

    ZIR(K)=TEMP(K)-ZIRWIIR(1)*AWP(2)                  | Handle last one
    ZIRWIIR(1)=ZIR(K)                                 | differently.

Repeat the above for the next K
```

---

*5.10 VQ Target Vector Computation*

VQ TARGET VECTOR COMPUTATION (block 11)

Input: SW, ZIR

Output: TARGET

Function: Subtract the zero-input response vector from the weighted speech vector.

Note: *ZIR (K)=ZIRWIIR (IDIM +1−K)* from block 10 above. It does not require a separate storage location

```
For K=1,2,....,IDIM, do the next line
    TARGET(K) = SW(K) - ZIR(K)
```

---

*5.11 Codebook Search Module (block 24)*

The 7 blocks contained within the codebook search module (block 24) are specified below. Again, some blocks are described as a single block for convenience and implementation efficiency. Blocks 12, 14, and 15 are executed once every adaptation cycle when ICOUNT=3, while the other blocks are executed once every speech vector.

IMPULSE RESPONSE VECTOR CALCULATOR (block 12)

Input: A, AWZ, AWP

Output: H

Function: Compute the impulse response vector of the cascaded synthesis filter and perceptual weighting filter.

This block is executed when ICOUNT=3 and after the execution of block 23 and 3 is completed (i.e., when the new sets of A, AWZ, AWP coefficients are ready).

```
TEMP(1)=1.                                  | TEMP = synthesis filter memory
RC(1)=1.                                    | RC = W(z) all-pole part memory
For K=2,3,....,IDIM, do the following
    A0=0.
    A1=0.
    A2=0.
    For I=K,K-1,....,3,2, do the next 5 lines
        TEMP(I)=TEMP(I-1)
        RC(I)=RC(I-1)                        |
        A0=A0-A(I)*TEMP(I)                   | Filtering.
        A1=A1+AWZ(I)*TEMP(I)                 |
        A2=A2-AWP(I)*RC(I)

    TEMP(1)=A0
    RC(1)=A0+A1+A2
Repeat the above indented section for the next K

ITMP=IDIM+1                                 | Obtain h(n) by reversing
For K=1,2,....,IDIM, do the next line       | the order of the memory of
    H(K)=RC(ITMP-K)                         | all-pole section of W(z)
```

---

SHAPE CODEVECTOR CONVOLUTION MODULE AND ENERGY TABLE CALCULATOR (blocks 14 and 15)

Input: H, Y

Output: Y2

Function: Convolve each shape codevector with the impulse response obtained in block 12, then compute and store the energy of the resulting vector.

This block is also executed when ICOUNT=3 after the execution of block 12 is completed.

```
For J=1,2,...,NCWD, do the following          | One codevector per loop.
    J1=(J-1)*IDIM
    For K=1,,2,...,IDIM, do the next 4 lines
        K1=J1+K+1
        TEMP(K)=0.
        For I=1,2,...,K, do the next line     |
            TEMP(K)=TEMP(K)+H(I)*Y(K1-I)      | Convolution.
    Repeat the above 4 lines for the next K

    Y2(J)=0.
    For K=1,2,...,IDIM, do the next line      |
        Y2(J)=Y2(J)+TEMP(K)*TEMP(K)           | Compute energy.

Repeat the above for the next J
```

---

VQ TARGET VECTOR NORMALIZATION (block 16)

Input: TARGET, GAIN

Output: TARGET

Function: Normalize the VQ target vector using the predicted excitation gain.

```
TMP = 1. / GAIN
For K=1,2,...,IDIM, do the next line
    TARGET(K) = TARGET(K) * TMP
```

---

TIME-REVERSED CONVOLUTION MODULE (block 13)

Input: H, TARGET (output from block 16)

Output: PN

Function: Perform time-reversed convolution of the impulse response vector and the normalized VQ target vector (to obtain the vector $p(n)$).

Note: The vector PN can be kept in temporary storage.

```
For K=1,2,...,IDIM, do the following
    K1=K-1
    PN(K)=0.
    For J=K,K+1,...,IDIM, do the next line
        PN(K)=PN(K)+TARGET(J)*H(J-K1)

Repeat the above for the next K
```

---

ERROR CALCULATOR AND BEST CODEBOOK INDEX SELECTOR (blocks 17 and 18)

Input: PN, Y, Y2, GB, G2, GSQ

Output: IG, IS, ICHAN

Function: Search through the gain codebook and the shape codebook to identify the best combination of gain codebook index and shape codebook index, and combine the two to obtain the 10-bit best codebook index.

Notes: The variable COR used below is usually kept in an accumulator, rather than storing it in memory. The variables IDXG and J can be kept in temporary registers, while IG and IS can be kept in memory.

```
        Initialize DISTM to the largest number representable in the hardware
        N1=NG/2
        For J=1,2,...,NCWD, do the following
            J1=(J-1)*IDIM
            COR=0.
            For K=1,2,...,IDIM, do the next line  |
                COR=COR+PN(K)*Y(J1+K)             | Compute inner product Pj.

            If COR > 0., then do the next 5 lines
                IDXG=N1
                For K=1,2,...,N1-1, do the next "if" statement
                    If COR < GB(K)*Y2(J), do the next 2 lines
                        IDXG=K                    | Best positive gain found.
                        GO TO LABEL

            If COR ≤ 0., then do the next 5 lines
               IDXG=NG
                For K=N1+1,N1+2,...,NG-1, do the next "if" statement
                    If COR > GB(K)*Y2(J), do the next 2 lines
                        IDXG=K                    | Best negative gain found.
                        GO TO LABEL

LABEL:      D=-G2(IDXG)*COR+GSQ(IDXG)*Y2(J)       | Compute distortion D̂.

            If D < DISTM, do the next 3 lines
                DISTM=D                           | Save the lowest distortion
                IG=IDXG                           | and the best codebook
                IS=J                              | indices so far..

        Repeat the above indented section for the next J

        ICHAN = (IS - 1) * NG + (IG - 1)          | Concatenate shape and gain
                                                  | codebook indices.

        Transmit ICHAN through communication channel.
```

---

*5.12 Simulated Decoder (block 8)*

Blocks 20 and 23 have been described earlier. Blocks 19, 21, and 22 are specified below.

EXCITATION VQ CODEBOOK (block 19)

Input: IG, IS

Output: YN

Function: Perform table look-up to extract the best shape codevector and the best gain, then multiply them to get the quantized excitation vector.

```
        NN = (IS-1)*IDIM
        For K=1,2,...,IDIM, do the next line
            YN(K) = GQ(IG) * Y(NN+K)
```

---

GAIN SCALING UNIT (block 21)

Input: GAIN, YN

Output: ET

Function: multiply the quantized excitation vector by the excitation gain.

```
For K=1,2,...,IDIM, do the next line
    ET(K) = GAIN * YN(K)
```

---

SYNTHESIS FILTER (block 22)

Input: ET, A

Output: ST

Function: Filter the gain-scaled excitation vector to obtain the quantized speech vector As explained in Section 3, this block can be omitted and the quantized speech vector can be obtained as a by-product of the memory update procedure to be described below. If, however, one wish to implement this block anyway, a separate set of filter memory (rather than STATELPC) should be used for this all-pole synthesis filter.

*5.13 Filter Memory Update for Blocks 9 and 10*

The following description of the filter memory update procedures for blocks 9 and 10 assumes that the quantized speech vector ST is obtained as a by-product of the memory updates. To safeguard possibl overloading of signal levels, a magnitude limiter is built into the procedure so that the filter memory clips at MAX and MIN, where MAX and MIN are respectively the positive and negative saturation levels of A-law or μ-law PCM, depending on which law is used.

FILTER MEMORY UPDATE (blocks 9 and 10)

Input: ET, A, AWZ, AWP, STATELPC, ZIRWFIR, ZIRWIIR

Output: ST, STATELPC, ZIRWFIR, ZIRWIIR

Function: Update the filter memory of blocks 9 and 10 and also obtain the quantized speech vector.

```
ZIRWFIR(1)=ET(1)                          | ZIRWFIR now a scratch array.
TEMP(1)=ET(1)
For K=2,3,...,IDIM, do the following
    A0=ET(K)
    A1=0.
    A2=0.
    For I=K,K-1,...,2,do the next 5 lines
        ZIRWFIR(I)=ZIRWFIR(I-1)
        TEMP(I)=TEMP(I-1)
        A0=A0-A(I)*ZIRWFIR(I)             |
        A1=A1+AWZ(I)*ZIRWFIR(I)           | Compute zero-state responses
        A2=A2-AWP(I)*TEMP(I)              | at various stages of the
                                          | cascaded filter.
    ZIRWFIR(1)=A0                         |
    TEMP(1)=A0+A1+A2

Repeat the above indented section for the next K
```

```
                                    | Now update filter memory by adding
                                    | zero-state responses to zero-input
                                    | responses
For K=1,2,...,IDIM, do the next 4 lines
    STATELPC(K)=STATELPC(K)+ZIRWFIR(K)
    If STATELPC(K) > MAX, set STATELPC(K)=MAX    | Limit the range.
    If STATELPC(K) < MIN, set STATELPC(K)=MIN    |
    ZIRWIIR(K)=ZIRWIIR(K)+TEMP(K)

For I=1,2,...,LPCW, do the next line      | Now set ZIRWFIR to the
    ZIRWFIR(I)=STATELPC(I)                | right value.

I=IDIM+1
For K=1,2,...,IDIM, do the next line      | Obtain quantized speech by
    ST(K)=STATELPC(I-K)                   | reversing order of synthesis
                                          | filter memory.
```

---

*5.14 Decoder (Fig. 3)*

The blocks in the decoder (Fig. 3) are described below. Except for the output PCM format conversion block, all other blocks are exactly the same as the blocks in the simulated decoder (block 8) in Fig. 2.

The decoder only uses a subset of the variables in Table 2. If a decoder and an encoder are to be implemented in a single DSP chip, then the decoder variables should be given different names to avoid overwriting the variables used in the simulated decoder block of the encoder. For example, to name the decoder variables, we can add a prefix "d" to the corresponding variable names in Table 2. If a decoder is to be implemented as a stand-alone unit independent of an encoder, then there is no need to change the variable names.

The following description assumes a stand-alone decoder. Again, the blocks are executed in the same order they are described below.

DECODER BACKWARD SYNTHESIS FILTER ADAPTER (block 33)

Input: ST

Output: A

Function: Generate synthesis filter coefficients periodically from previously decoded speech.

The operation of this block is exactly the same as block 23 of the encoder.

---

DECODER BACKWARD VECTOR GAIN ADAPTER (block 30)

Input: ET

Output: GAIN

Function: Generate the excitation gain from previous gain-scaled excitation vectors.

The operation of this block is exactly the same as block 20 of the encoder.

---

DECODER EXCITATION VQ CODEBOOK (block 29)

Input: ICHAN

Output: YN

Function: Decode the received best codebook index (channel index) to obtain the excitation vector.

This block first extract the 3-bit gain codebook index IG and the 7-bit shape codebook index IS from the received 10-bit channel index. Then, the rest of the operation is exactly the same as block 19 of the encoder.

```
ITMP = integer part of (ICHAN / NG)        | Decode (IS-1).
IG = ICHAN - ITMP * NG + 1                 | Decode IG.

NN = ITMP * IDIM
For K=1,2,...,IDIM, do the next line
    YN(K) = GQ(IG) * Y(NN+K)
```

---

DECODER GAIN SCALING UNIT (block 31)

Input: GAIN, YN

Output: ET

Function: Multiply the excitation vector by the excitation gain.

The operation of this block is exactly the same as block 21 of the encoder.

---

DECODER SYNTHESIS FILTER (block 32)

Input: ET, A, STATELPC

Output: ST

Function: Filter the gain-scaled excitation vector to obtain the decoded speech vector.

This block can be implemented as a straightforward all-pole filter. However, as mentioned in Section 4.3, if the encoder obtains the quantized speech as a by-product of filter memory update (to save computation), and if potential accumulation of round-off error is a concern, then this block should compute the decoded speech in exactly the same way as in the simulated decoder block of the encoder. That is, the decoded speech vector should be computed as the sum of the zero-input response vector and the zero-state response vector of the synthesis filter. This can be done by the following procedure.

```
For K=1,2,...,IDIM, do the next 7 lines
    TEMP(K)=0.
    For J=LPC,LPC-1,...,3,2, do the next 2 lines
        TEMP(K)=TEMP(K)-STATELPC(J)*A(J+1)        | Zero-input response.
        STATELPC(J)=STATELPC(J-1)

    TEMP(K)=TEMP(K)-STATELPC(1)*A(2)              | Handle last one
    STATELPC(1)=TEMP(K)                           | differently.

Repeat the above for the next K
```

```
TEMP(1)=ET(1)
For K=2,3,...,IDIM, do the next 5 lines
    A0=ET(K)
    For I=K,K-1,...,2, do the next 2 lines
        TEMP(I)=TEMP(I-1)
        A0=A0-A(I)*TEMP(I)            | Compute zero-state response

    TEMP(1)=A0

Repeat the above 5 lines for the next K

                                  | Now update filter memory by adding
                                  | zero-state responses to zero-input
                                  | responses
For K=1,2,...,IDIM, do the next 3 lines
    STATELPC(K)=STATELPC(K)+TEMP(K)              | ZIR + ZSR
    If STATELPC(K) > MAX, set STATELPC(K)=MAX    | Limit the range
    If STATELPC(K) < MIN, set STATELPC(K)=MIN    |

I=IDIM+1
For K=1,2,...,IDIM, do the next line     | Obtain quantized speech
    ST(K)=STATELPC(I-K)                  | reversing order of state
                                         | filter memory.
```

---

10th-ORDER LPC INVERSE FILTER (block 81)

This block is executed once a vector, and the output vector is written sequentially into the last 20 samples of the LPC prediction residual buffer (i.e. D(81) through D(100)). We use a pointer IP to point to the address of D(K) array samples to be written to. This pointer IP is initialized to NPWSZ-NFRSZ+IDIM before this block starts to process the first decoded speech vector of the first adaptation cycle (frame), and from there on IP is updated in the way described below. The 10th-order LPC predictor coefficients APF(I)'s are obtained in the middle of Levinson-Durbin recursion by block 50, as described in Sec. 4.6. It is assumed that before this block starts execution, the decoder synthesis filter (block 32 of Fig. 3) has already written the current decoded speech vector into ST(1) through ST(IDIM).

Input: ST, APF

Output: D

Function: Compute the LPC prediction residual for the current decoded speech vector.

```
If IP = NPWSZ, then set IP = NPWSZ - NFRSZ          | check & update IP

  For K=1,2,...,IDIM, do the next 7 lines
    ITMP=IP+K
      D(ITMP) = ST(K)
      For J=10,9,...,3,2, do the next 2 lines
          D(ITMP) = D(ITMP) + STLPCI(J)*APF(J+1)     | FIR filtering.
          STLPCI(J) = STLPCI(J-1)                    | Memory shift.
      D(ITMP) = D(ITMP) + STLPCI(1)*APF(2)           | Handle last one.
      STLPCI(1) = ST(K)                              | shift in input.

  IP = IP + IDIM                                     | update IP.
```

PITCH PERIOD EXTRACTION MODULE (block 82)

This block is executed once a frame at the third vector of each frame, after the third decoded speech vector is generated.

Input: D

Output: KP

Function: Extract the pitch period from the LPC prediction residual

```
If ICOUNT ≠ 3, skip the execution of this block;
Otherwise, do the following.
                                  | lowpass filtering & 4:1 downsampling :
  For K=NPWSZ-NFRSZ+1,...,NPWSZ, do the next 7 lines
   TMP=D(K)-STLPF(1)*AL(1)-STLPF(2)*AL(2)-STLPF(3)*AL(3)  | IIR filtering
   If K is divisible by 4, do the next 2 lines
      N=K/4                       | do FIR filtering only if needed
      DEC(N)=TMP*BL(1)+STLPF(1)*BL(2)+STLPF(2)*BL(3)+STLPF(3)*BL ;
   STLPF(3)=STLPF(2)

   STLPF(2)=STLPF(1)              | shift lowpass filter memory.
   STLPF(1)=TMP

M1 = KPMIN/4                      | start correlation peak-picking in
M2 = KPMAX/4                      | the decimated LPC residual domain.
CORMAX = most negative number of the machine
For J=M1,M1+1,...,M2, do the next 6 lines
   TMP=0
   For N=1,2,...,NPWSZ/4, do the next line
      TMP=TMP+DEC(N)*DEC(N-J)     | TMP = correlation in decimated domain
   If TMP > CORMAX, do the next 2 lines
      CORMAX=TMP                  | find maximum correlation and
      KMAX=J                      | the corresponding lag.
For N=-M2+1,-M2+2,...,(NPWSZ-NFRSZ)/4, do the next line
   DEC(N)=DEC(N+IDIM)             | shift decimated LPC residual buffer.

M1=4*KMAX-3       | start correlation peak-picking in undecimated domain
M2=4*KMAX+3
If M1 < KPMIN, set M1 = KPMIN.    | check whether M1 out of range.
If M2 > KPMAX, set M2 = KPMAX.    | check whether M2 out of range.
CORMAX = most negative number of the machine
For J=M1,M1+1,...,M2, do the next 6 lines
   TMP=0.
   For K=1,2,...,NPWSZ, do the next line
      TMP=TMP+D(K)*D(K-J)         | correlation in undecimated domain.
   If TMP > CORMAX, do the next 2 lines
      CORMAX=TMP                  | find maximum correlation and
      KP=J                        | the corresponding lag.

M1 = KP1 - KPDELTA                | determine the range of search around
M2 = KP1 + KPDELTA                | the pitch period of previous frame.
If KP < M2+1, go to LABEL.        | KP can't be a multiple pitch if true.
If M1 < KPMIN, set M1 = KPMIN.    | check whether M1 out of range.
CMAX = most negative number of the machine
  For J=M1,M1+1,...,M2, do the next 6 lines
     TMP=0.
     For K=1,2,...,NPWSZ, do the next line
        TMP=TMP+D(K)*D(K-J)       | correlation in undecimated domain.
     If TMP > CMAX, do the next 2 lines
```

```
        CMAX=TMP                        | find maximum correlation and
        KPTMP=J                         | the corresponding lag.
    SUM=0.
    TMP=0.                              | start computing the tap weights
    For K=1,2,...,NPWSZ, do the next 2 lines
       SUM = SUM + D(K-KP)*D(K-KP)
       TMP = TMP + D(K-KPTMP)*D(K-KPTMP)
    If SUM=0, set TAP=0; otherwise, set TAP=CORMAX/SUM.
    If TMP=0, set TAP1=0; otherwise, set TAP1=CMAX/TMP.
    If TAP > 1, set TAP = 1.          | clamp TAP between 0 and 1
    If TAP < 0, set TAP = 0.
    If TAP1 > 1, set TAP1 = 1.        | clamp TAP1 between 0 and 1
    If TAP1 < 0, set TAP1 = 0.
                                      | Replace KP with fundamental pit
                                      | TAP1 is large enough.
    If TAP1 > TAPTH * TAP, then set KP = KPTMP.

LABEL:  KP1 = KP                      | update pitch period of previous frame
    For K=-KPMAX+1,-KPMAX+2,...,NPWSZ-NFRSZ, do the next line
       D(K) = D(K+NFRSZ)              | shift the LPC residual buffer
```

---

PITCH PREDICTOR TAP CALCULATOR (block 83)

This block is also executed once a frame at the third vector of each frame, right after the execution of block 82. This block shares the decoded speech buffer (ST(K) array) with the long-term postfilter 71, which takes care of the shifting of the array such that ST(1) through ST(IDIM) constitute the current vector of decoded speech, and ST(-KPMAX-NPWSZ+1) through ST(0) are previous vectors of decoded speech.

Input: ST, KP

Output: PTAP

Function: Calculate the optimal tap weight of the single-tap pitch predictor of the decoded speech.

```
If ICOUNT ≠ 3, skip the execution of this block;
Otherwise, do the following.
  SUM=0.
  TMP=0.
  For K=-NPWSZ+1,-NPWSZ+2,...,0, do the next 2 lines
     SUM = SUM + ST(K-KP)*ST(K-KP)
     TMP = TMP + ST(K)*ST(K-KP)
  If SUM=0, set PTAP=0; otherwise, set PTAP=TMP/SUM.
```

---

LONG-TERM POSTFILTER COEFFICIENT CALCULATOR (block 84)

This block is also executed once a frame at the third vector of each frame, right after the execution of block 83.

Input: PTAP

Output: B, GL

Function: Calculate the coefficient $b$ and the scaling factor $g_l$ of the long-term postfilter.

```
If ICOUNT ≠ 3, skip the execution of this block;
Otherwise, do the following.
```

```
  If PTAP > 1, set PTAP = 1.          | clamp PTAP at 1.
  If PTAP < PPFTH, set PTAP = 0.      | turn off pitch postfilter if
                                      | PTAP smaller than threshold
B = PPFZCF * PTAP
GL = 1 / (1+B)
```

---

SHORT-TERM POSTFILTER COEFFICIENT CALCULATOR (block 85)

This block is also executed once a frame, but it is executed at the first vector of each frame.

Input: APF, RCTMP(1)

Output: AP, AZ, TILTZ

Function: Calculate the coefficients of the short-term postfilter.

```
If ICOUNT ≠ 1, skip the execution of this block;
Otherwise, do the following.
  For I=2,3,...,11, do the next 2 lines |
      AP(I)=SPFPCFV(I)*APF(I)           | scale denominator coeff.
      AZ(I)=SPFZCFV(I)*APF(I)           | scale numerator coeff.
  TILTZ=TILTF*RCTMP(1)                  | tilt compensation filter coeff.
```

---

LONG-TERM POSTFILTER (block 71)

This block is executed once a vector.

Input: ST, B, GL, KP

Output: TEMP

Function: Perform filtering operation of the long-term postfilter.

```
For K=1,2,...,IDIM, do the next line
    TEMP(K)=GL*(ST(K)+B*ST(K-KP))       | long-term postfiltering.

For K=-NPWSZ-KPMAX+1,...,-2,-1,0, do the next line
    ST(K)=ST(K+IDIM)                    | shift decoded speech buffer.
```

---

SHORT-TERM POSTFILTER (block 72)

This block is executed once a vector right after the execution of block 71.

Input: AP, AZ, TILTZ, STPFFIR, STPFIIR, TEMP (output of block 71)

Output: TEMP

Function: Perform filtering operation of the short-term postfilter.

```
For K=1,2,...,IDIM, do the following
  TMP = TEMP(K)
    For J=10,9,...,3,2, do the next 2 lines
        TEMP(K) = TEMP(K) + STPFFIR(J)*AZ(J+1)     | All-zero part
        STPFFIR(J) = STPFFIR(J-1)                  | of the filter.
    TEMP(K) = TEMP(K) + STPFFIR(1)*AZ(2)           | Last multiplier.
    STPFFIR(1) = TMP
```

```
For J=10,9,...,3,2, do the next 2 lines
    TEMP(K) = TEMP(K) - STPFIIR(J)*AP(J+1)      | All-pole part
    STPFIIR(J) = STPFIIR(J-1)                   | of the filter.
TEMP(K) = TEMP(K) - STPFIIR(1)*AP(2)            | Last multiplier.
STPFIIR(1) = TEMP(K)
TEMP(K) = TEMP(K) + STPFIIR(2)*TILTZ            | Spectral tilt com-
                                                | pensation filter.
```

---

SUM OF ABSOLUTE VALUE CALCULATOR (block 73)

This block is executed once a vector after execution of block 32.

Input: ST

Output: SUMUNFIL

Function: Calculate the sum of absolute values of the components of the decoded speech vector.

```
SUMUNFIL=0.
FOR K=1,2,...,IDIM, do the next line
    SUMUNFIL = SUMUNFIL + absolute value of ST(K)
```

---

SUM OF ABSOLUTE VALUE CALCULATOR (block 74)

This block is executed once a vector after execution of block 72.

Input: TEMP (output of block 72)

Output: SUMFIL

Function: Calculate the sum of absolute values of the components of the short-term postfilter output vector.

```
SUMFIL=0.
FOR K=1,2,...,IDIM, do the next line
    SUMFIL = SUMFIL + absolute value of TEMP(K)
```

---

SCALING FACTOR CALCULATOR (block 75)

This block is executed once a vector after execution of blocks 73 and 74.

Input: SUMUNFIL, SUMFIL

Output: SCALE

Function: Calculate the overall scaling factor of the postfilter

```
If SUMFIL > 1, set SCALE = SUMUNFIL / SUMFIL;
Otherwise, set SCALE = 1.
```

---

FIRST-ORDER LOWPASS FILTER (block 76) and OUTPUT GAIN SCALING UNIT (block 77)

This two blocks are executed once a vector after execution of blocks 72 and 75. It is more convenient to describe the two blocks together.

Input: SCALE, TEMP (output of block 72)

Output: SPF

Function: Lowpass filter the once-a-vector scaling factor and use the filtered scaling factor to scale the short-term postfilter output vector.

```
For K=1,2,...,IDIM, do the following
    SCALEFIL = AGCFAC*SCALEFIL + (1-AGCFAC)*SCALE    | lowpass filtering
    SPF(K) = SCALEFIL*TEMP(K)                        | scale output.
```

---

OUTPUT PCM FORMAT CONVERSION (block 28)

Input: SPF

Output: SD

Function: Convert the 5 components of the decoded speech vector into 5 corresponding A-law or μ-law PCM samples and put them out sequentially at 125 μs time intervals.

The conversion rules from uniform PCM to A-law or μ-law PCM is specified in G.711.

ANNEX A

HYBRID WINDOW FUNCTIONS FOR VARIOUS LPC ANALYSES IN LD-CELP

In the LD-CELP coder, we use three separate LPC analyses to update the coefficients of three filters: (1) the synthesis filter, (2) the log-gain predictor, and (3) the perceptual weighting filter. Each of these three LPC analyses has its own hybrid window. For each hybrid window, we list the values of window function samples that are used in the hybrid windowing calculation procedure. These window functions were first designed using floating-point arithmetic and then quantized to the numbers which can be exactly represented by 16-bit representations with 15 bits of fraction. For each window, we will first give a table containing the floating-point equivalent of the 16-bit numbers and then give a table with corresponding 16-bit integer representations.

A.1 Hybrid Window for the Synthesis Filter

The following table contains the first 105 samples of the window function for the synthesis filter. The first 35 samples are the non-recursive portion, and the rest are the recursive portion. The table should be read from left to right from the first row, then left to right for the second row, and so on (just like the raster scan line).

| | | | | |
|---|---|---|---|---|
| 0.047760010 | 0.095428467 | 0.142852783 | 0.189971924 | 0.236663818 |
| 0.282775879 | 0.328277588 | 0.373016357 | 0.416900635 | 0.459838867 |
| 0.501739502 | 0.542480469 | 0.582000732 | 0.620178223 | 0.656921387 |
| 0.692199707 | 0.725891113 | 0.757904053 | 0.788208008 | 0.816680908 |
| 0.843322754 | 0.868041992 | 0.890747070 | 0.911437988 | 0.930053711 |
| 0.946533203 | 0.960876465 | 0.973022461 | 0.982910156 | 0.990600586 |
| 0.996002197 | 0.999114990 | 0.999969482 | 0.998565674 | 0.994842529 |
| 0.988861084 | 0.981781006 | 0.974731445 | 0.967742920 | 0.960815430 |
| 0.953948975 | 0.947082520 | 0.940307617 | 0.933563232 | 0.926879883 |
| 0.920227051 | 0.913635254 | 0.907104492 | 0.900604248 | 0.894134521 |
| 0.887725830 | 0.881378174 | 0.875061035 | 0.868774414 | 0.862548828 |
| 0.856384277 | 0.850250244 | 0.844146729 | 0.838104248 | 0.832092285 |
| 0.826141357 | 0.820220947 | 0.814331055 | 0.808502197 | 0.802703857 |
| 0.796936035 | 0.791229248 | 0.785583496 | 0.779937744 | 0.774353027 |

| | | | | |
|---|---|---|---|---|
| 0.768798828 | 0.763305664 | 0.757812500 | 0.752380371 | 0.747009277 |
| 0.741638184 | 0.736328125 | 0.731048584 | 0.725830078 | 0.720611572 |
| 0.715454102 | 0.710327148 | 0.705230713 | 0.700164795 | 0.695159912 |
| 0.690185547 | 0.685241699 | 0.680328369 | 0.675445557 | 0.670593262 |
| 0.665802002 | 0.661041260 | 0.656280518 | 0.651580811 | 0.646911621 |
| 0.642272949 | 0.637695313 | 0.633117676 | 0.628570557 | 0.624084473 |
| 0.619598389 | 0.615142822 | 0.610748291 | 0.606384277 | 0.602020264 |

The next table contains the corresponding 16-bit integer representation. Dividing the table entries by $2^{15} = 32768$ gives the table above.

| | | | | |
|---|---|---|---|---|
| 1565 | 3127 | 4681 | 6225 | 7755 |
| 9266 | 10757 | 12223 | 13661 | 15068 |
| 16441 | 17776 | 19071 | 20322 | 21526 |
| 22682 | 23786 | 24835 | 25828 | 26761 |
| 27634 | 28444 | 29188 | 29866 | 30476 |
| 31016 | 31486 | 31884 | 32208 | 32460 |
| 32637 | 32739 | 32767 | 32721 | 32599 |
| 32403 | 32171 | 31940 | 31711 | 31484 |
| 31259 | 31034 | 30812 | 30591 | 30372 |
| 30154 | 29938 | 29724 | 29511 | 29299 |
| 29089 | 28881 | 28674 | 28468 | 28264 |
| 28062 | 27861 | 27661 | 27463 | 27266 |
| 27071 | 26877 | 26684 | 26493 | 26303 |
| 26114 | 25927 | 25742 | 25557 | 25374 |
| 25192 | 25012 | 24832 | 24654 | 24478 |
| 24302 | 24128 | 23955 | 23784 | 23613 |
| 23444 | 23276 | 23109 | 22943 | 22779 |
| 22616 | 22454 | 22293 | 22133 | 21974 |
| 21817 | 21661 | 21505 | 21351 | 21198 |
| 21046 | 20896 | 20746 | 20597 | 20450 |
| 20303 | 20157 | 20013 | 19870 | 19727 |

A.2 Hybrid Window for the Log-Gain Predictor

The following table contains the first 34 samples of the window function for the log-gain predictor. The first 20 samples are the non-recursive portion, and the rest are the recursive portion. The table should be read in the same manner as the two tables above.

| | | | | |
|---|---|---|---|---|
| 0.092346191 | 0.183868408 | 0.273834229 | 0.361480713 | 0.446014404 |
| 0.526763916 | 0.602996826 | 0.674072266 | 0.739379883 | 0.798400879 |
| 0.850585938 | 0.895507813 | 0.932769775 | 0.962066650 | 0.983154297 |
| 0.995819092 | 0.999969482 | 0.995635986 | 0.982757568 | 0.961486816 |
| 0.932006836 | 0.899078369 | 0.867309570 | 0.836669922 | 0.807128906 |
| 0.778625488 | 0.751129150 | 0.724578857 | 0.699005127 | 0.674316406 |
| 0.650482178 | 0.627502441 | 0.605346680 | 0.583953857 | |

The next table contains the corresponding 16-bit integer representation. Dividing the table entries by $2^{15} = 32768$ gives the table above.

| | | | | |
|---|---|---|---|---|
| 3026 | 6025 | 8973 | 11845 | 14615 |
| 17261 | 19759 | 22088 | 24228 | 26162 |
| 27872 | 29344 | 30565 | 31525 | 32216 |
| 32631 | 32767 | 32625 | 32203 | 31506 |
| 30540 | 29461 | 28420 | 27416 | 26448 |
| 25514 | 24613 | 23743 | 22905 | 22096 |
| 21315 | 20562 | 19836 | 19135 | |

A.3 Hybrid Window for the Perceptual Weighting Filter

The following table contains the first 60 samples of the window function for the perceptual weighting filter. The first 30 samples are the non-recursive portion, and the rest are the recursive portion. The table should be read in the same manner as the four tables above.

| | | | | |
|---|---|---|---|---|
| 0.059722900 | 0.119262695 | 0.178375244 | 0.236816406 | 0.294433594 |
| 0.351013184 | 0.406311035 | 0.460174561 | 0.512390137 | 0.562774658 |
| 0.611145020 | 0.657348633 | 0.701171875 | 0.742523193 | 0.781219482 |
| 0.817108154 | 0.850097656 | 0.880035400 | 0.906829834 | 0.930389404 |
| 0.950622559 | 0.967468262 | 0.980865479 | 0.990722656 | 0.997070313 |
| 0.999847412 | 0.999084473 | 0.994720459 | 0.986816406 | 0.975372314 |
| 0.960449219 | 0.943939209 | 0.927734375 | 0.911804199 | 0.896148682 |
| 0.880737305 | 0.865600586 | 0.850738525 | 0.836120605 | 0.821746826 |
| 0.807647705 | 0.793762207 | 0.780120850 | 0.766723633 | 0.753570557 |
| 0.740600586 | 0.727874756 | 0.715393066 | 0.703094482 | 0.691009521 |
| 0.679138184 | 0.667480469 | 0.656005859 | 0.644744873 | 0.633666992 |
| 0.622772217 | 0.612091064 | 0.601562500 | 0.591217041 | 0.581085205 |

The next table contains the corresponding 16-bit integer representation. Dividing the table entries by $2^{15} = 32768$ gives the table above.

| | | | | |
|---|---|---|---|---|
| 1957 | 3908 | 5845 | 7760 | 9648 |
| 11502 | 13314 | 15079 | 16790 | 18441 |
| 20026 | 21540 | 22976 | 24331 | 25599 |
| 26775 | 27856 | 28837 | 29715 | 30487 |
| 31150 | 31702 | 32141 | 32464 | 32672 |
| 32763 | 32738 | 32595 | 32336 | 31961 |
| 31472 | 30931 | 30400 | 29878 | 29365 |
| 28860 | 28364 | 27877 | 27398 | 26927 |
| 26465 | 26010 | 25563 | 25124 | 24693 |
| 24268 | 23851 | 23442 | 23039 | 22643 |
| 22254 | 21872 | 21496 | 21127 | 20764 |
| 20407 | 20057 | 19712 | 19373 | 19041 |

ANNEX B

EXCITATION SHAPE AND GAIN CODEBOOK TABLES

This appendix first gives the 7-bit excitation VQ shape codebook table. Each row in the table specifies one of the 128 shape codevectors. The first column is the channel index associated with each shape codevector (obtained by a Gray-code index assignment algorithm). The second through the sixth columns are the first through the fifth components of the 128 shape codevectors as represented in 16-bit fixed point. To obtain the floating point value from the integer value, divide the integer value by 2048. This is equivalent to multiplication by $2^{-11}$ or shifting the binary point 11 bits to the left.

| Channel Index | Codevector Components | | | | |
|---|---|---|---|---|---|
| 0 | 668 | -2950 | -1254 | -1790 | -2553 |
| 1 | -5032 | -4577 | -1045 | 2908 | 3318 |
| 2 | -2819 | -2677 | -948 | -2825 | -4450 |
| 3 | -6679 | -340 | 1482 | -1276 | 1262 |

| | | | | | |
|---|---|---|---|---|---|
| 4 | -562 | -6757 | 1281 | 179 | -1274 |
| 5 | -2512 | -7130 | -4925 | 6913 | 2411 |
| 6 | -2478 | -156 | 4683 | -3873 | 0 |
| 7 | -8208 | 2140 | -478 | -2785 | 533 |
| 8 | 1889 | 2759 | 1381 | -6955 | -5913 |
| 9 | 5082 | -2460 | -5778 | 1797 | 568 |
| 10 | -2208 | -3309 | -4523 | -6236 | -7505 |
| 11 | -2719 | 4358 | -2988 | -1149 | 2664 |
| 12 | 1259 | 995 | 2711 | -2464 | -10390 |
| 13 | 1722 | -7569 | -2742 | 2171 | -2329 |
| 14 | 1032 | 747 | -858 | -7946 | -12843 |
| 15 | 3106 | 4856 | -4193 | -2541 | 1035 |
| 16 | 1862 | -960 | -6628 | 410 | 5882 |
| 17 | -2493 | -2628 | -4000 | -60 | 7202 |
| 18 | -2672 | 1446 | 1536 | -3831 | 1233 |
| 19 | -5302 | 6912 | 1589 | -4187 | 3665 |
| 20 | -3456 | -8170 | -7709 | 1384 | 4698 |
| 21 | -4699 | -6209 | -11176 | 8104 | 16830 |
| 22 | 930 | 7004 | 1269 | -8977 | 2567 |
| 23 | 4649 | 11804 | 3441 | -5657 | 1199 |
| 24 | 2542 | -183 | -8859 | -7976 | 3230 |
| 25 | -2872 | -2011 | -9713 | -8385 | 12983 |
| 26 | 3086 | 2140 | -3680 | -9643 | -2896 |
| 27 | -7609 | 6515 | -2283 | -2522 | 6332 |
| 28 | -3333 | -5620 | -9130 | -11131 | 5543 |
| 29 | -407 | -6721 | -17466 | -2889 | 11568 |
| 30 | 3692 | 6796 | -262 | -10846 | -1856 |
| 31 | 7275 | 13404 | -2989 | -10595 | 4936 |
| 32 | 244 | -2219 | 2656 | 3776 | -5412 |
| 33 | -4043 | -5934 | 2131 | 863 | -2866 |
| 34 | -3302 | 1743 | -2006 | -128 | -2052 |
| 35 | -6361 | 3342 | -1583 | -21 | 1142 |
| 36 | -3837 | -1831 | 6397 | 2545 | -2848 |
| 37 | -9332 | -6528 | 5309 | 1986 | -2245 |
| 38 | -4490 | 748 | 1935 | -3027 | -493 |
| 39 | -9255 | 5366 | 3193 | -4493 | 1784 |
| 40 | 4784 | -370 | 1866 | 1057 | -1889 |
| 41 | 7342 | -2690 | -2577 | 676 | -611 |
| 42 | -502 | 2235 | -1850 | -1777 | -2049 |
| 43 | 1011 | 3880 | -2465 | 2209 | -152 |
| 44 | 2592 | 2829 | 5588 | 2839 | -7306 |
| 45 | -3049 | -4918 | 5955 | 9201 | -4447 |
| 46 | 697 | 3908 | 5798 | -4451 | -4644 |
| 47 | -2121 | 5444 | -2570 | 321 | -1202 |
| 48 | 2846 | -2086 | 3532 | 566 | -708 |
| 49 | -4279 | 950 | 4980 | 3749 | 452 |
| 50 | -2484 | 3502 | 1719 | -170 | 238 |
| 51 | -3435 | 263 | 2114 | -2005 | 2361 |
| 52 | -7338 | -1208 | 9347 | -1216 | -4013 |
| 53 | -13498 | -439 | 8028 | -4232 | 361 |
| 54 | -3729 | 5433 | 2004 | -4727 | -1259 |
| 55 | -3986 | 7743 | 8429 | -3691 | -987 |
| 56 | 5198 | -423 | 1150 | -1281 | 816 |
| 57 | 7409 | 4109 | -3949 | 2690 | 30 |
| 58 | 1246 | 3055 | -35 | -1370 | -246 |
| 59 | -1489 | 5635 | -678 | -2627 | 3170 |
| 60 | 4830 | -4585 | 2008 | -1062 | 799 |
| 61 | -129 | 717 | 4594 | 14937 | 10706 |
| 62 | 417 | 2759 | 1850 | -5057 | -1153 |

| | | | | | |
|---|---|---|---|---|---|
| 63 | -3887 | 7361 | -5768 | 4285 | 666 |
| 64 | 1443 | -938 | 20 | -2119 | -1697 |
| 65 | -3712 | -3402 | -2212 | 110 | 2136 |
| 66 | -2952 | 12 | -1568 | -3500 | -1855 |
| 67 | -1315 | -1731 | 1160 | -558 | 1709 |
| 68 | 88 | -4569 | 194 | -454 | -2957 |
| 69 | -2839 | -1666 | -273 | 2084 | -155 |
| 70 | -189 | -2376 | 1663 | -1040 | -2449 |
| 71 | -2842 | -1369 | 636 | -248 | -2677 |
| 72 | 1517 | 79 | -3013 | -3669 | -973 |
| 73 | 1913 | -2493 | -5312 | -749 | 1271 |
| 74 | -2903 | -3324 | -3756 | -3690 | -1829 |
| 75 | -2913 | -1547 | -2760 | -1406 | 1124 |
| 76 | 1844 | -1834 | 456 | 706 | -4272 |
| 77 | 467 | -4256 | -1909 | 1521 | 1134 |
| 78 | -127 | -994 | -637 | -1491 | -6494 |
| 79 | 873 | -2045 | -3828 | -2792 | -578 |
| 80 | 2311 | -1817 | 2632 | -3052 | 1968 |
| 81 | 641 | 1194 | 1893 | 4107 | 6342 |
| 82 | -45 | 1198 | 2160 | -1449 | 2203 |
| 83 | -2004 | 1713 | 3518 | 2652 | 4251 |
| 84 | 2936 | -3968 | 1280 | 131 | -1476 |
| 85 | 2827 | 8 | -1928 | 2658 | 3513 |
| 86 | 3199 | -816 | 2687 | -1741 | -1407 |
| 87 | 2948 | 4029 | 394 | -253 | 1298 |
| 88 | 4286 | 51 | -4507 | -32 | -659 |
| 89 | 3903 | 5646 | -5588 | -2592 | 5707 |
| 90 | -606 | 1234 | -1607 | -5187 | 664 |
| 91 | -525 | 3620 | -2192 | -2527 | 1707 |
| 92 | 4297 | -3251 | -2283 | 812 | -2264 |
| 93 | 5765 | 528 | -3287 | 1352 | 1672 |
| 94 | 2735 | 1241 | -1103 | -3273 | -3407 |
| 95 | 4033 | 1648 | -2965 | -1174 | 1444 |
| 96 | 74 | 918 | 1999 | 915 | -1026 |
| 97 | -2496 | -1605 | 2034 | 2950 | 229 |
| 98 | -2168 | 2037 | 15 | -1264 | -208 |
| 99 | -3552 | 1530 | 581 | 1491 | 962 |
| 100 | -2613 | -2338 | 3621 | -1488 | -2185 |
| 101 | -1747 | 81 | 5538 | 1432 | -2257 |
| 102 | -1019 | 867 | 214 | -2284 | -1510 |
| 103 | -1684 | 2816 | -229 | 2551 | -1389 |
| 104 | 2707 | 504 | 479 | 2783 | -1009 |
| 105 | 2517 | -1487 | -1596 | 621 | 1929 |
| 106 | -148 | 2206 | -4288 | 1292 | -1401 |
| 107 | -527 | 1243 | -2731 | 1909 | 1280 |
| 108 | 2149 | -1501 | 3688 | 610 | -4591 |
| 109 | 3306 | -3369 | 1875 | 3636 | -1217 |
| 110 | 2574 | 2513 | 1449 | -3074 | -4979 |
| 111 | 814 | 1826 | -2497 | 4234 | -4077 |
| 112 | 1664 | -220 | 3418 | 1002 | 1115 |
| 113 | 781 | 1658 | 3919 | 6130 | 3140 |
| 114 | 1148 | 4065 | 1516 | 815 | 199 |
| 115 | 1191 | 2489 | 2561 | 2421 | 2443 |
| 116 | 770 | -5915 | 5515 | -368 | -3199 |
| 117 | 1190 | 1047 | 3742 | 6927 | -2089 |
| 118 | 292 | 3099 | 4308 | -758 | -2455 |
| 119 | 523 | 3921 | 4044 | 1386 | 85 |
| 120 | 4367 | 1006 | -1252 | -1466 | -1383 |
| 121 | 3852 | 1579 | -77 | 2064 | 868 |

| | | | | | |
|---|---|---|---|---|---|
| 122 | 5109 | 2919 | -202 | 359 | -509 |
| 123 | 3650 | 3206 | 2303 | 1693 | 1296 |
| 124 | 2905 | -3907 | 229 | -1196 | -2332 |
| 125 | 5977 | -3585 | 805 | 3825 | -3138 |
| 126 | 3746 | -606 | 53 | -269 | -3301 |
| 127 | 606 | 2018 | -1316 | 4064 | 398 |

Next we give the values for the gain codebook. This table not only includes the values for GQ, but also the values for GB, G2 and GSQ as well. Both GQ and GB can be represented exactly in 16-bit arithmetic using Q13 format. The fixed point representation of G2 is just the same as GQ, except the format is now Q12. An approximate representation of GSQ to the nearest integer in fixed point will suffice.

| Array Index | 1 | 2 | 3 | 4 | 5 | 6 | 7 | 8 |
|---|---|---|---|---|---|---|---|---|
| GQ ** | 0.515625 | 0.90234375 | 1.579101563 | 2.763427734 | -GQ(1) | -GQ(2) | -GQ(3) | -GQ(4) |
| GB | 0.708984375 | 1.240722656 | 2.171264649 | * | -GB(1) | -GB(2) | -GB(3) | * |
| G2 | 1.03125 | 1.8046875 | 3.158203126 | 5.526855468 | -G2(1) | -G2(2) | -G2(3) | -G2(4) |
| GSQ | 0.26586914 | 0.814224243 | 2.493561746 | 7.636532841 | GSQ(1) | GSQ(2) | GSQ(3) | GSQ(4) |

* Can be any arbitrary value (not used).

** Note that GQ(1) = 33/64, and GQ(i)=(7/4)GQ(i-1) for i=2,3,4.

Table Values of Gain Codebook Related Arrays

ANNEX C

VALUES USED FOR BANDWIDTH BROADENING

The following table gives the integer values for the pole control, zero control and bandwidth broadening vectors listed in Table 2. To obtain the floating point value, divide the integer value by 16384. The values in this table represent these floating point values in the Q14 format, the most commonly used format to represent numbers less than 2 in 16 bit fixed point arithmetic.

| i | FACV | FACGPV | WPCFV | WZCFV | SPFPCFV | SPFZCFV |
|---|---|---|---|---|---|---|
| 1 | 16384 | 16384 | 16384 | 16384 | 16384 | 16384 |
| 2 | 16192 | 14848 | 9830 | 14746 | 12288 | 10650 |
| 3 | 16002 | 13456 | 5898 | 13271 | 9216 | 6922 |
| 4 | 15815 | 12195 | 3539 | 11944 | 6912 | 4499 |
| 5 | 15629 | 11051 | 2123 | 10750 | 5184 | 2925 |
| 6 | 15446 | 10015 | 1274 | 9675 | 3888 | 1901 |
| 7 | 15265 | 9076 | 764 | 8707 | 2916 | 1236 |
| 8 | 15086 | 8225 | 459 | 7836 | 2187 | 803 |
| 9 | 14910 | 7454 | 275 | 7053 | 1640 | 522 |
| 10 | 14735 | 6755 | 165 | 6347 | 1230 | 339 |
| 11 | 14562 | 6122 | 99 | 5713 | 923 | 221 |
| 12 | 14391 | | | | | |
| 13 | 14223 | | | | | |
| 14 | 14056 | | | | | |
| 15 | 13891 | | | | | |
| 16 | 13729 | | | | | |
| 17 | 13568 | | | | | |
| 18 | 13409 | | | | | |
| 19 | 13252 | | | | | |
| 20 | 13096 | | | | | |
| 21 | 12943 | | | | | |
| 22 | 12791 | | | | | |
| 23 | 12641 | | | | | |

| | |
|---|---|
| 24 | 12493 |
| 25 | 12347 |
| 26 | 12202 |
| 27 | 12059 |
| 28 | 11918 |
| 29 | 11778 |
| 30 | 11640 |
| 31 | 11504 |
| 32 | 11369 |
| 33 | 11236 |
| 34 | 11104 |
| 35 | 10974 |
| 36 | 10845 |
| 37 | 10718 |
| 38 | 10593 |
| 39 | 10468 |
| 40 | 10346 |
| 41 | 10225 |
| 42 | 10105 |
| 43 | 9986 |
| 44 | 9869 |
| 45 | 9754 |
| 46 | 9639 |
| 47 | 9526 |
| 48 | 9415 |
| 49 | 9304 |
| 50 | 9195 |
| 51 | 9088 |

ANNEX D

COEFFICIENTS OF THE 1 kHz LOWPASS ELLIPTIC FILTER USED IN PITCH PERIOD EXTRACTION MODULE (BLOCK 72)

The 1 kHz lowpass filter used in the pitch lag extraction and encoding module (block 74) is a third-order pole-zero filter with a transfer function of $$L(z) = \frac{\sum_{i=0}^{3} b_i z^{-i}}{1 + \sum_{i=1}^{3} a_i z^{-i}}$$

where the coefficients $a_i$'s and $b_i$'s are given in the following tables.

| $i$ | $a_i$ | $b_i$ |
|---|---|---|
| 0 | — | 0.0357081667 |
| 1 | -2.34036589 | -0.0069956244 |
| 2 | 2.01190019 | -0.0069956244 |
| 3 | -0.614109218 | 0.0357081667 |

ANNEX E

TIME SCHEDULING THE SEQUENCE OF COMPUTATIONS

All of the computation in the encoder and decoder can be divided up into two classes. Included in the first class are those computations which take place once per vector. Sections 3 through 5.14 note which computations these are. Generally they are the ones which involve or lead to the actual quantization of the excitation signal and the synthesis of the output signal. Referring specifically to the block numbers in Fig. 2, this class includes blocks 1, 2, 4, 9, 10, 11, 13, 16, 17, 18, 21, and 22. In Fig. 3, this class includes blocks 28, 29, 31, 32 and 34. In Fig. 6, this class includes blocks 39, 40, 41, 42, 46, 47, 48, and 67. (Note that Fig. 6 is applicable to both block 20 in Fig. 2 and block 30 in Fig. 3. Blocks 43, 44 and 45 of Fig. 6 are not part of this class. Thus, blocks 20 and 30 are part of both classes.)

In the other class are those computations which are only done once for every four vectors. Once more referring to Figures 2 through 8, this class includes blocks 3, 12, 14, 15, 23, 33, 35, 36, 37, 38, 43, 44, 45, 49, 50, 51, 81, 82, 83, 84, and 85. All of the computations in this second class are associated with updating one or more of the adaptive filters or predictors in the coder. In the encoder there are three such adaptive structures, the 50th order LPC synthesis filter, the vector gain predictor, and the perceptual weighting filter. In the decoder there are four such structures, the synthesis filter, the gain predictor, and the long term and short term adaptive postfilters. Included in the descriptions of sections 4 through 5.14 are the times and input signals for each of these five adaptive structures. Although it is redundant, this appendix explicitly lists all of this timing information in one place for the convenience of the reader. The following table summarizes the five adaptive structures, their input signals, their times of computation and the time at which the updated values are first used. For reference, the fourth column in the table refers to the block numbers used in the figures and in sections 4 and 5 as a cross reference to these computations.

By far, the largest amount of computation is expended in updating the 50th order synthesis filter. The input signal required is the synthesis filter output speech (ST). As soon as the fourth vector in the previous cycle has been decoded, the hybrid window method for computing the autocorrelation coefficients can commence (block 49). When it is completed, Durbin's recursion to obtain the prediction coefficients can begin (block 50). In practice we found it necessary to stretch this computation over more than one vector cycle. We begin the hybrid window computation before vector 1 has been fully received. Before Durbin's recursion can be fully completed, we must interrupt it to encode vector 1. Durbin's recursion is not completed until vector 2. Finally bandwidth expansion (block 51) is applied to the predictor coefficients. The results of this calculation are not used until the encoding or decoding of vector 3 because in the encoder we need to combine these updated values with the update of the perceptual weighting filter and codevector energies. These updates are not available until vector 3.

The gain adaptation precedes in two fashions. The adaptive predictor is updated once every four vectors. However, the adaptive predictor produces a new gain value once per vector. In this section we are describing the timing of the update of the predictor. To compute this requires first performing the hybrid window method on the previous log gains (block 43), then Durbin's recursion (block 44), and bandwidth expansion (block 45). All of this can be completed during vector 2 using the log gains available up through vector 1. If the result of Durbin's recursion indicates there is no singularity, then the new gain predictor is used immediately in the encoding of vector 2.

The perceptual weighting filter update is computed during vector 3. The first part of this update is performing the LPC analysis on the input speech up through vector 2. We can begin this computation immediately after vector 2 has been encoded, not waiting for vector 3 to be fully received. This consists of performing the hybrid window method (block 36), Durbin's recursion (block 37) and the weighting filter coefficient calculations (block 38). Next we need to combine the perceptual weighting filter with the updated synthesis filter to compute the impulse response vector calculator (block 12). We also must convolve every shape codevector with this impulse response to find the codevector energies (blocks 14 and 15). As soon as these computations are completed, we can immediately use all of the updated values in the encoding of vector 3. (Note: Because the computation of codevector energies is fairly intensive, we were unable to complete the perceptual weighting filter update as part of the computation during the time of vector 2, even if the gain predictor update were moved elsewhere. This is why it was deferred to vector 3.)

The long term adaptive postfilter is updated on the basis of a fast pitch extraction algorithm which uses the synthesis filter output speech (ST) for its input. Blocks 82 and 83 form the pitch predictor. Since the postfilter is only used in the decoder, scheduling time to perform this computation was based on the other

| Timing of Adapter Updates | | | |
|---|---|---|---|
| Adapter | Input Signal(s) | First Use of Updated Parameters | Reference Blocks |
| Backward Synthesis Filter Adapter | Synthesis filter output speech (ST) through vector 4 | Encoding/ Decoding vector 3 | 23, 33 (49,50,51) |
| Backward Vector Gain Adapter | Log gains through vector 1 | Encoding/ Decoding vector 2 | 20, 30 (43,44,45) |
| Adapter for Perceptual Weighting Filter & Fast Codebook Search | Input speech (S) through vector 2 | Encoding vector 3 | 3 (36,37,38) 12, 14, 15 |
| Adapter for Long Term Adaptive Postfilter | Synthesis filter output speech (ST) through vector 3 | Synthesizing postfiltered vector 3 | 35 (81 - 84) |
| Adapter for Short Term Adaptive Postfilter | Synthesis filter output Speech (ST) through vector 4 | Synthesizing postfiltered vector 1 | 35 (85) |

computational loads in the decoder. The decoder does not have to update the perceptual weighting filter and codevector energies, so the time slot of vector 3 is available. The codeword for vector 3 is decoded and its synthesis filter output speech is available together with all previous synthesis output vectors. These are input to the adapter which then produces the new pitch period (blocks 81 and 82) and long-term postfilter coefficient (blocks 83 and 84). These new values are immediately used in calculating the postfiltered output for vector 3.

The short term adaptive postfilter is updated as a by-product of the synthesis filter update. Durbin's recursion is stopped at order 10 and the prediction coefficients are saved for the postfilter update. Since the Durbin computation is usually begun during vector 1, the short term adaptive postfilter update is completed in time for the postfiltering of output vector 1.

In the claims:

1. A method of encoding comprising:

(a) receiving a set of input audio samples representative of an audio signal, the set of input audio samples comprising a first portion and a second portion;

(b) applying a first hybrid window to the second portion of the set of input audio samples to generate a first windowed second portion;

(c) generating a set of quantized audio samples approximating the set of input audio samples, the set of quantized audio samples comprising a first portion and a second portion;

(d) applying a second hybrid window to the second portion of the set of quantized audio samples to generate a second windowed second portion;

(e) generating a modified digital signal obtained from a set of gain scaled excitation samples, the modified digital signal comprising a first portion and a second portion;

(f) applying a third hybrid window to the second portion of the modified digital signal to generate a third windowed second portion; the first hybrid window, the second hybrid window and the third hybrid window being represented by $w_m(n)$ according to the equations:

$$w_m(n)=f_m(n)=b\alpha^{-[n-(m-N-1)]}$$

if $n \leqq m-N-1$ $$w_m(n)=g_m(n)=-\sin[c(n-m)]$$

if $m-N \leqq n \leqq m-1$ $w_m(n)=0$ if $n \geqq m$ and wherein N is equal to about 30 and $\alpha$ is equal to about 0.98282 for the first hybrid window, N is equal to about 35 and $\alpha$ is equal to about 0.99283 for the second hybrid window, and N is equal to about 20 and $\alpha$ is equal to about 0.96468 for the third hybrid window;

(g) calculating a first plurality of coefficients from the first windowed second portion;

(h) calculating a second plurality of coefficients from the second windowed second portion;

(i) calculating a third plurality of coefficients from the third windowed second portion;

(j) deriving a first set of predictor coefficients, a second set of predictor coefficients, and a third set of predictor coefficients from the first plurality of coefficients, the second plurality of coefficients, and the third plurality of coefficients, respectively;

(l) outputting the index.

2. The method of claim 1 wherein the first portion and the second portion of the set of input audio samples are mutually exclusive.

3. The method of claim 1 wherein b is about 0.960 and c is about 0.060 for the first hybrid window, b is about 0.989 and c is about 0.048 for the second hybrid window, and b is about 0.932 and c is about 0.092 for the third hybrid window.

4. A method of decoding comprising:

(a) receiving an index associated with an excitation vector, the excitation vector being representative of a set of audio samples;

(b) choosing a set of previously quantized audio samples;

(c) applying a first hybrid window to the set of previously quantized audio samples to generate a first windowed portion;

(d) determining a modified digital signal obtained from a previous set of gain scaled excitation samples;

(e) applying a second hybrid window to the modified digital signal to generate a second windowed portion; the first hybrid window and the second hybrid window being represented by $w_m(n)$ according to the equations:

$$w_m(n)=f_m(n)=b\alpha^{-[n-(m-N-1)]}$$

if $n \leqq m-N-1$ $$w_m(n)=g_m(n)=-\sin[c(n-m)]$$

if $m-N \leqq n \leqq m-1$ $$w_m(n)=0$$

if $n \geqq m$ and wherein N is equal to about 35 and $\alpha$ is equal to about 0.99283 for the first hybrid window and N is equal to about 20 and $\alpha$ is equal to about 0.96468 for the second hybrid window;

(g) calculating a first plurality of coefficients from the first windowed portion;

(h) calculating a second plurality of coefficients from the second windowed portion;

(i) deriving a first set of predictor coefficients and a second set of predictor coefficients from the first plurality of coefficients and the second plurality of coefficients, respectively;

(j) generating an audio signal by gain adjusting and filtering the excitation vector, the filtering being based upon the first set of predictor coefficients and the gain adjusting being based upon the second set of predictor coefficients; and (k) outputting a signal representative of the audio signal.

5. The method of claim 4 further comprising the steps of:

(a) postfiltering the signal representative of the audio signal to generate a postfiltered signal; and (b) converting the postfiltered signal to a PCM output format.

6. The method of claim 4 wherein b is about 0.989 and c is about 0.048 for the first hybrid window and b is about 0.932 and c is about 0.092 for the second hybrid window.

7. A method for processing an audio signal comprising:

(a) receiving a set of input audio samples representative of an audio signal, the set of input audio samples comprising a first portion and a second portion;

(b) applying a hybrid window to the second portion of the set of input audio samples to generate a windowed second portion, the hybrid window being represented by $w_m(n)$ according to the equations:

$$w_m(n)=f_m(n)=b\alpha^{-[n-(m-N-1)]}$$

if $n \leqq m-N-1$ $$w_m(n)=g_m(n)=-\sin[c(n-m)]$$

if $m-N \leqq n \leqq m-1$ $$w_m(n)=0$$

if $n \geqq m$} and wherein N is equal to about 30 and $\alpha$ is equal to about 0.98282;

(c) calculating a plurality of coefficients from the windowed second portion;

(d) deriving a set of predictor coefficients from the plurality of coefficients;

(e) choosing, from an excitation codebook, an excitation vector based upon the set of predictor coefficients, the excitation vector having an index associated therewith and being representative of the first portion of the set of input audio samples; and (f) outputting the index.

8. The method of claim 7 wherein b is about 0.960 and c is about 0.060 for the hybrid window.

* * * * *